US011047353B2

(12) United States Patent
Saito et al.

(10) Patent No.: US 11,047,353 B2
(45) Date of Patent: Jun. 29, 2021

(54) HIGH-PRESSURE FUEL SUPPLY PUMP

(71) Applicant: Hitachi Automotive Systems, Ltd., Hitachinaka (JP)

(72) Inventors: Atsuji Saito, Hitachinaka (JP); Satoshi Usui, Hitachinaka (JP); Kazuaki Tokumaru, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 0 days.

(21) Appl. No.: 16/769,952

(22) PCT Filed: Nov. 20, 2018

(86) PCT No.: PCT/JP2018/042752
§ 371 (c)(1),
(2) Date: Jun. 4, 2020

(87) PCT Pub. No.: WO2019/111692
PCT Pub. Date: Jun. 13, 2019

(65) Prior Publication Data

US 2020/0392930 A1 Dec. 17, 2020

(30) Foreign Application Priority Data

Dec. 5, 2017 (JP) ..... JP2017-233727

(51) Int. Cl.

| | |
|---|---|
| ***F02M 59/44*** | (2006.01) |
| ***F02M 55/04*** | (2006.01) |
| *F02M 59/36* | (2006.01) |
| *F02M 63/02* | (2006.01) |

(52) U.S. Cl.
CPC ..... *F02M 59/442* (2013.01); *F02M 55/04* (2013.01); *F02M 59/366* (2013.01);
(Continued)

(58) Field of Classification Search
CPC .. F02M 59/442; F02M 55/04; F02M 63/0225; F02M 2200/315; F02M 2200/8084
See application file for complete search history.

(56) References Cited

U.S. PATENT DOCUMENTS

2009/0288639 A1 11/2009 Usui et al.
2013/0052064 A1 2/2013 Oikawa et al.
(Continued)

FOREIGN PATENT DOCUMENTS

JP 2009-264239 A 11/2009
JP 2011-220196 A 11/2011
(Continued)

OTHER PUBLICATIONS

International Search Report (PCT/ISA/210) issued in PCT Application No. PCT/JP2018/042752 dated Mar. 26, 2019 with English translation (four (4) pages).
(Continued)

*Primary Examiner* — George C Jin
(74) *Attorney, Agent, or Firm* — Crowell & Moring LLP

(57) ABSTRACT

Provided is a high-pressure fuel supply pump capable of reducing a manufacturing cost of a part for holding a metal damper. The high-pressure fuel supply pump includes a pump body 1 having a pressurizing chamber 11 therein, a damper cover 14 forming a damper chamber 10 together with the pump body 1 on the upstream side of the pressurizing chamber 11, a metal damper 9 that is disposed in the damper cover 10 and formed by laminating two metal diaphragms, and a first holding member 9*a* that is disposed in the damper chamber 10 and presses and holds the metal damper 9 from one side. The first holding member 9*a* includes a first regulation portion that regulates the radial movement of the metal damper 9, and a second regulation portion that regulates the radial movement of the first holding member 9*a* in the damper chamber 10. At a position
(Continued)

of the second regulation portion, a flow path is formed which allows the fuel in the damper chamber 10 to circulate to both surfaces of the metal damper 9.

12 Claims, 15 Drawing Sheets

(52) U.S. Cl.
CPC ... *F02M 63/0225* (2013.01); *F02M 2200/315* (2013.01); *F02M 2200/8084* (2013.01)

(56) References Cited

U.S. PATENT DOCUMENTS

| | | | | |
|---|---|---|---|---|
| 2018/0258892 | A1* | 9/2018 | Zankl | F04B 1/0443 |
| 2019/0063388 | A1* | 2/2019 | Kurt | F02M 55/04 |
| 2020/0332751 | A1* | 10/2020 | Hwang | F02M 55/04 |
| 2020/0355150 | A1* | 11/2020 | Iwa | F02M 59/36 |

FOREIGN PATENT DOCUMENTS

| | | | |
|---|---|---|---|
| JP | 2012-184757 | A | 9/2012 |
| JP | 2013-60944 | A | 4/2013 |
| JP | 2014-240660 | A | 12/2014 |

OTHER PUBLICATIONS

Japanese-language Written Opinion (PCT/ISA/237) issued in PCT Application No. PCT/JP2018/042752 dated Mar. 26, 2019 (seven (7) pages).

* cited by examiner

HIGH-PRESSURE FUEL SUPPLY PUMP

TECHNICAL FIELD

The present invention relates to a high-pressure fuel supply pump for an internal combustion engine, and more particularly, to a high-pressure fuel supply pump provided with a pressure pulsation reduction mechanism upstream of a pressurizing chamber for pressurizing fuel.

BACKGROUND ART

In high-pressure fuel supply pumps, a pressure pulsation reduction mechanism for reducing pressure pulsation generated in the pump is housed in a damper chamber formed in a low-pressure fuel passage. Among the high-pressure fuel supply pumps equipped with a pressure pulsation reduction mechanism, there is a known device that reduces the number of parts during the work of assembling a metal diaphragm damper (metal damper) as a pressure pulsation reduction mechanism into the low-pressure fuel passage, and reduces parts shortage and incorrect assembly (for example, see PTL 1).

The high-pressure fuel supply pump described in PTL 1 includes a metal damper in which two disc-shaped metal diaphragms are joined over the entire circumference and a sealed space is formed inside the joint, and gas is enclosed in the sealed space of the damper. Further, a pair of pressing members for applying a pressing force to both outer surfaces of the metal damper at a position radially inward of the joint is provided. The pair of pressing members are combined into a unit while interposing the metal damper. The unitized metal damper and the pair of pressing members (damper unit) are housed and held in a damper chamber formed by the pump body and a cover member attached to the pump body.

CITATION LIST

Patent Literature

PTL 1: JP 2009-264239 A

SUMMARY OF INVENTION

Technical Problem

In the high-pressure fuel supply pump described in PTL 1, in order to position the pair of pressing members (damper unit) holding the metal damper, it is necessary to process a part of the pump body, so that the manufacturing cost increases accordingly. Further, in order to spread fuel to both surfaces of the metal damper, it is necessary to process a part of the pump body to form a flow path communicating with the damper chamber, thereby increasing the manufacturing cost. In addition, in order to spread fuel to both surfaces of the metal damper, it is necessary to secure the flow path communicating with the damper chamber by forming the cover member in a complicated shape (for example, a shape having a protruding portion having a missing portion), thereby increasing the manufacturing cost.

The invention has been made to solve the above problems, and an object thereof is to provide a high-pressure fuel supply pump capable of reducing a manufacturing cost of a part for holding a pressure pulsation reduction mechanism (damper).

Solution to Problem

The present application includes a plurality of means for solving the above-mentioned problems. For example, a pump body that includes a pressurizing chamber inside, a damper cover that forms a damper chamber on an upstream side of the pressurizing chamber together with the pump body, a damper that is disposed in the damper chamber and formed by laminating two diaphragms, and a first holding member that is disposed in the damper chamber and presses and holds the damper from one side are provided. The first holding member includes a first regulation portion for regulating movement of the damper in the radial direction, and a second regulation portion that regulates a radial movement of the first holding member in the damper chamber. A flow path that allows fuel in the damper chamber to circulate to both surfaces of the damper is formed at the position of the second regulation portion.

Advantageous Effects of Invention

According to the invention, the first holding member includes a first regulation portion that regulates the radial movement of the damper and a second regulation portion that regulates the radial movement of the damper itself, and a flow path for communicating with the damper chamber is formed at a position of the second regulation portion. Therefore, there is no need of positioning the first holding member and the damper with respect to the pump body and no need of processing for the flow path. Further, there is no need to secure a flow path depending on the shape of the damper cover. Therefore, the shapes of the parts of the pump body and the damper cover can be simplified, and the manufacturing cost of those parts can be reduced.

Objects, configurations, and effects besides the above description will be apparent through the explanation on the following embodiments.

DESCRIPTION OF EMBODIMENTS

Figure 1:
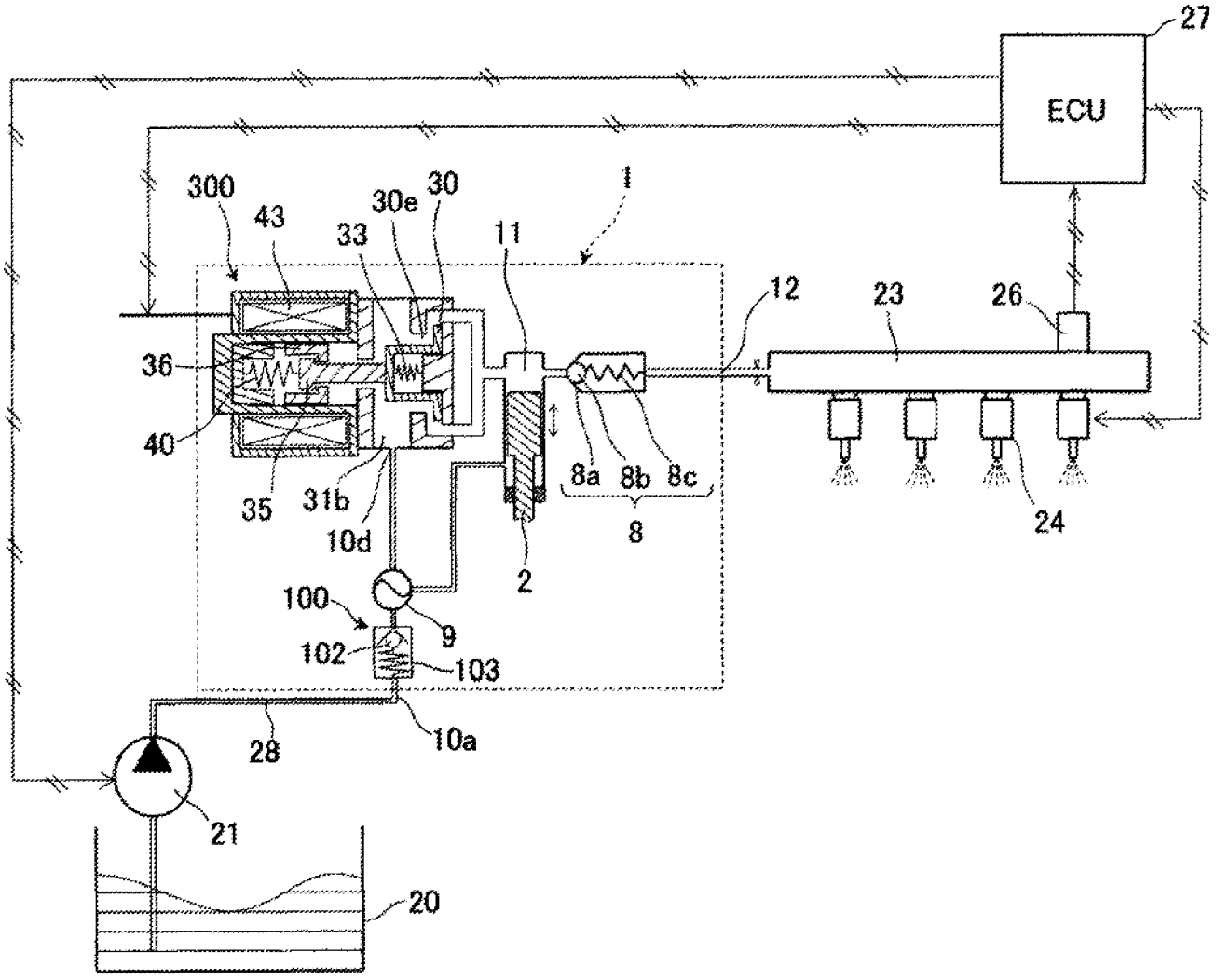
FIG. 1 is a configuration diagram illustrating a fuel supply system for an internal combustion engine including a high-pressure fuel supply pump according to a first embodiment of the invention.

Hereinafter, embodiments of the high-pressure fuel supply pump of the invention will be described with reference to the drawings. Further, the same symbol in the drawings represents the same portion.

First Embodiment (Fuel Supply System) First, the configuration and operation of a fuel supply system for an internal combustion engine including the high-pressure fuel supply pump according to a first embodiment of the invention will be described with reference to FIG. 1. FIG. 1 is a configuration diagram illustrating the fuel supply system for the internal combustion engine including the high-pressure fuel supply pump according to the first embodiment of the invention.

In FIG. 1, a portion surrounded by a broken line indicates a pump body 1 which is a main body of the high-pressure fuel supply pump. The mechanisms and components illustrated in the broken lines indicate that they are incorporated in the pump body 1.

In FIG. 1, the fuel supply system includes a fuel tank 20 for storing fuel, a feed pump 21 for pumping up and sending out the fuel in the fuel tank 20, and a high-pressure fuel supply pump for pressurizing and discharging a low-pressured fuel sent from the feed pump 21, and a plurality of injectors 24 for injecting the high-pressure fuel pumped from the high-pressure fuel supply pump. The high-pressure fuel supply pump is connected to the feed pump 21 via a suction pipe 28. The high-pressure fuel supply pump pumps fuel to the injector 24 via a common rail 23. The injectors 24 are mounted on the common rail 23 according to the number of cylinders of the engine. A pressure sensor 26 is mounted on the common rail 23. The pressure sensor 26 detects the pressure of the fuel discharged from the high-pressure fuel supply pump.

This high-pressure fuel supply pump is applied to a so-called direct injection engine system in which the injector 24 directly injects fuel into a cylinder of an engine as an internal combustion engine. The high-pressure fuel supply pump includes a pressurizing chamber 11 for pressurizing the fuel, an electromagnetic suction valve mechanism 300 as a variable capacity mechanism for adjusting the amount of fuel sucked into the pressurizing chamber 11, a plunger 2 for pressurizing the fuel in the pressurizing chamber 11 by reciprocating motion, and a discharge valve mechanism 8 for discharging the fuel pressurized by the plunger. On the upstream side of the electromagnetic suction valve mechanism 300, a metal damper 9 is provided as a pressure pulsation reduction mechanism for reducing the pressure pulsation generated in the high-pressure fuel supply pump from spreading to the suction pipe 28.

The feed pump 21, the electromagnetic suction valve mechanism 300, and the injector 24 are controlled by a control signal output from an engine control unit (hereinafter, referred to as an ECU) 27. The detection signal of the pressure sensor 26 is input to the ECU 27.

The fuel in the fuel tank 20 is pumped by a feed pump 21 driven based on the control signal of the ECU 27. This fuel is pressurized to an appropriate feed pressure by the feed pump 21 and sent to a low-pressure fuel suction port 10*a* of the high-pressure fuel supply pump through the suction pipe 28. The fuel that has passed through the low-pressure fuel suction port 10*a* reaches a suction port 31*b* of the electromagnetic suction valve mechanism 300 via the metal damper 9 and a suction passage 10*d*. The fuel flowing into the electromagnetic suction valve mechanism 300 passes through a suction valve 30 that opens and closes based on the control signal of the ECU 27. The fuel that has passed through the suction valve 30 is sucked into the pressurizing chamber 11 during a downward stroke of the reciprocating plunger 2 which reciprocates, and is pressurized in the pressurizing chamber 11 during an upward stroke of the plunger 2. The pressurized fuel is pumped to the common rail 23 via the discharge valve mechanism 8. The high-pressure fuel in the common rail 23 is injected into the cylinder of the engine by the injector 24 driven based on the control signal of the ECU 27.

The high-pressure fuel supply pump discharges a desired amount of fuel in response to the control signal from the ECU 27 to the electromagnetic suction valve mechanism 300.

The high-pressure fuel supply pump illustrated in FIG. 1 includes a pressure pulsation propagation prevention mechanism 100 upstream of the metal damper 9 (pressure pulsation reduction mechanism). The pressure pulsation propagation prevention mechanism 100 includes a valve seat (not illustrated), a valve 102 that comes into contact with and separates from the valve seat, a spring 103 that urges the valve 102 toward the valve seat, and a spring stopper (not illustrated) that limits the stroke of the valve 102. Further, the pressure pulsation propagation prevention mechanism 100 is not illustrated in drawings other than FIG. 1. In addition, the high-pressure fuel supply pump may be configured without the pressure pulsation propagation prevention mechanism.

(High-Pressure Fuel Supply Pump) Next, the configuration of each part of the high-pressure fuel supply pump according to the first embodiment of the invention will be described with reference to FIGS. 2 to 5.

Figure 2:
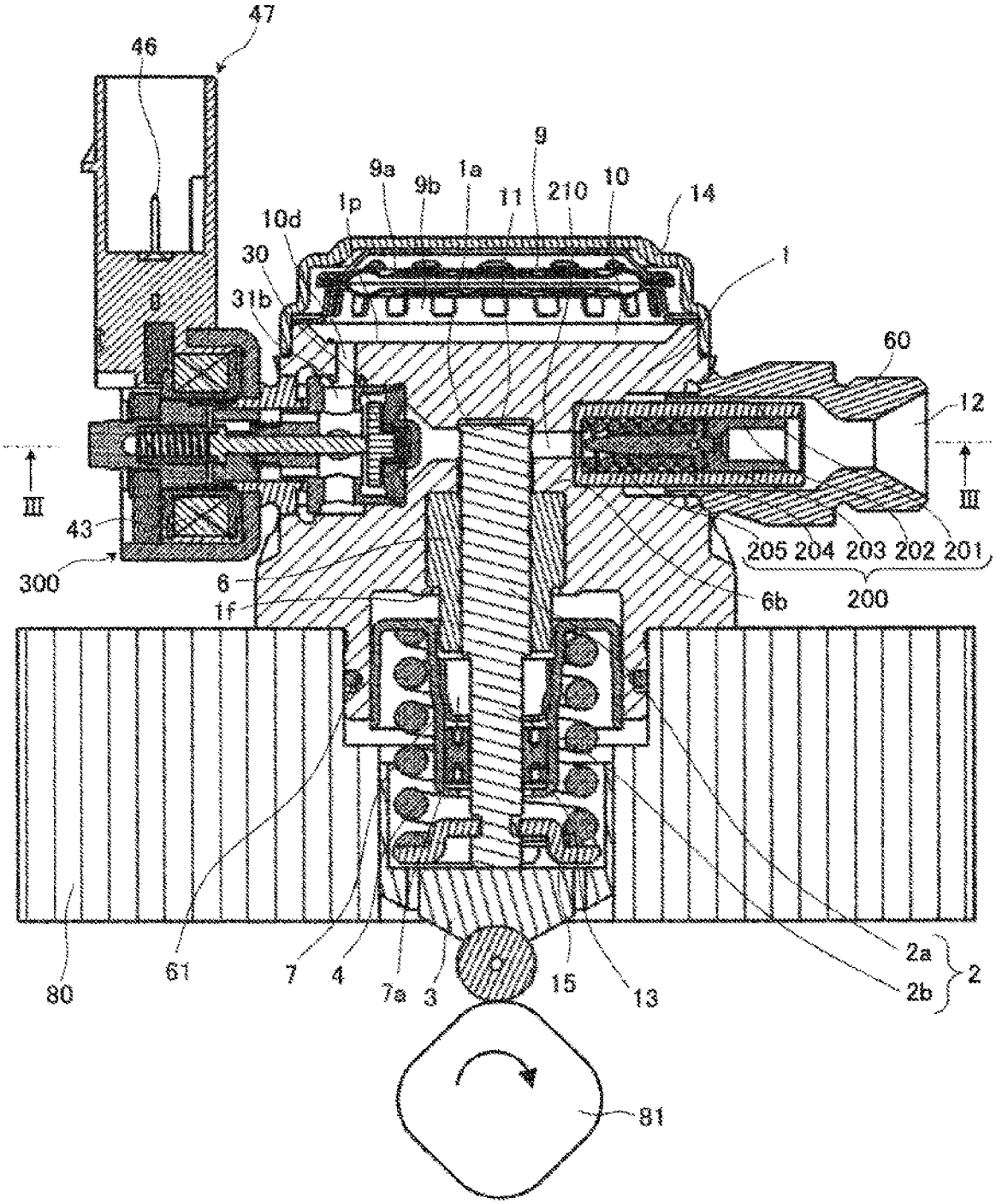
FIG. 2 is a longitudinal cross-sectional view illustrating the high-pressure fuel supply pump according to the first embodiment of the invention.
Figure 3:
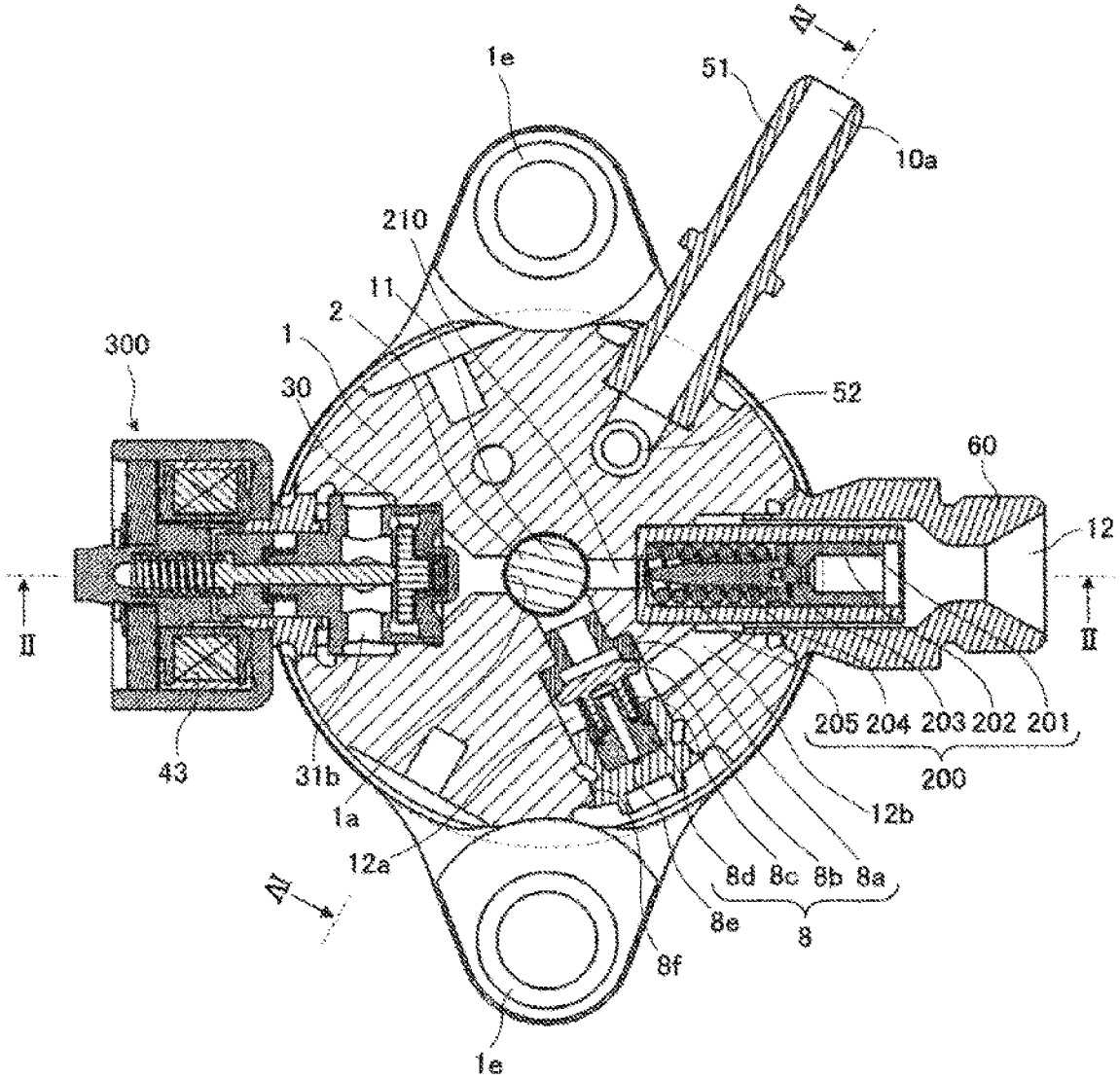
FIG. 3 is a lateral cross-sectional view of the high-pressure fuel supply pump according to the first embodiment of the invention illustrated in FIG. 2, as viewed from the direction of arrows III-III.
Figure 4:
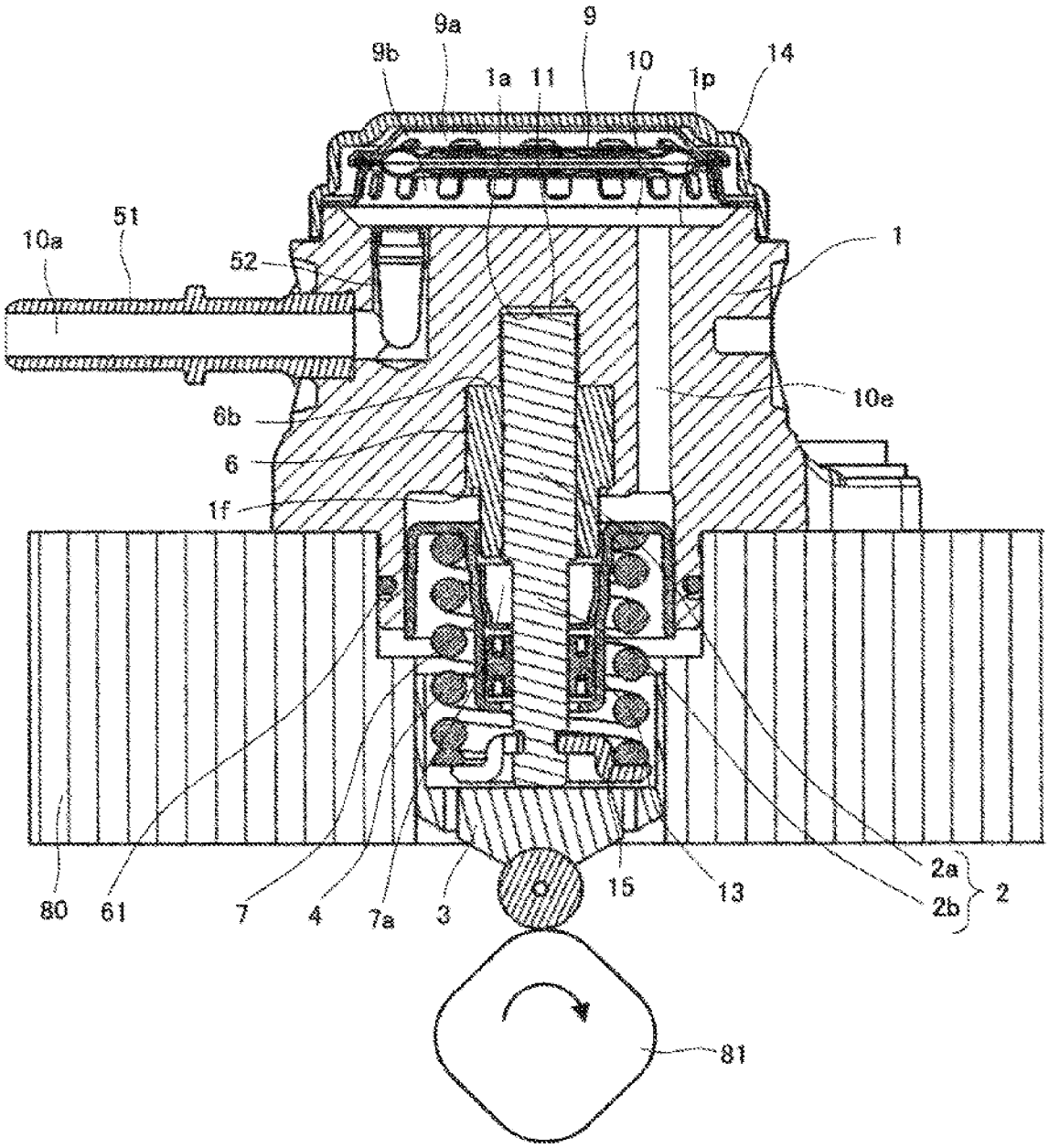
FIG. 4 is a longitudinal cross-sectional view illustrating a state in which the high-pressure fuel supply pump according to the first embodiment of the invention is cut along a plane (a plane different from FIG. 1) including both axes of a plunger and a suction joint.

FIG. 2 is a longitudinal cross-sectional view illustrating the high-pressure fuel supply pump according to the first embodiment of the invention. FIG. 3 is a lateral cross-sectional view of the high-pressure fuel supply pump according to the first embodiment of the invention illustrated in FIG. 2, as viewed from the direction of arrows III-III. FIG. 4 is a longitudinal cross-sectional view illustrating a state in which the high-pressure fuel supply pump according to the first embodiment of the invention is cut along a plane (a plane different from FIG. 1) including the both axes of a plunger and a suction joint.

Figure 5:
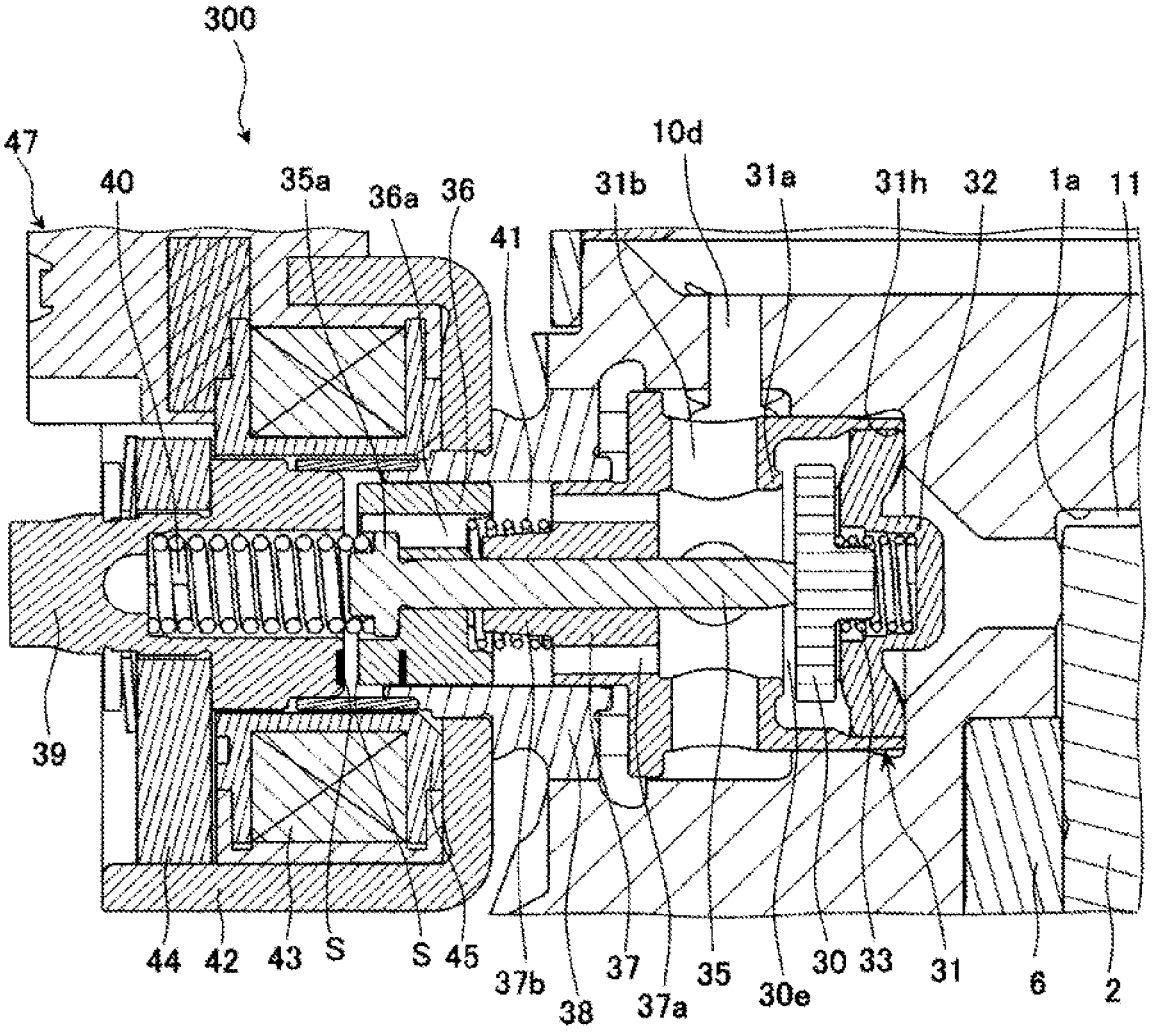
FIG. 5 is a longitudinal cross-sectional view illustrating an enlarged state of an electromagnetic suction valve mechanism that forms a part of the high-pressure fuel supply pump according to the first embodiment of the invention.

FIG. 5 is a longitudinal cross-sectional view illustrating an enlarged state of the electromagnetic suction valve mechanism that forms a part of the high-pressure fuel supply pump according to the first embodiment of the invention. Further, in FIG. 5, a part of the connector is omitted, and the electromagnetic suction valve mechanism is illustrated in an open state.

In FIG. 2, the high-pressure fuel supply pump includes a pump body 1 having the pressurizing chamber 11 therein, the plunger 2 mounted on the pump body 1, the electromagnetic suction valve mechanism 300, the discharge valve mechanism 8 (see FIG. 3), a relief valve mechanism 200, and the metal damper 9 as a pressure pulsation reduction mechanism. The high-pressure fuel supply pump is in close contact with a pump mounting portion 80 of the engine using a mounting flange 1*e* (see FIG. 3) provided at one end of the pump body 1, and is fixed with a plurality of bolts (not illustrated). An O-ring 61 is fitted on the outer peripheral surface of the pump body fitted with the pump mounting portion 80. The O-ring 61 seals between the pump mounting portion 80 and the pump body 1, and prevents engine oil and the like from leaking out of the engine.

As illustrated in FIGS. 2 and 4, the pump body 1 is provided with a bottomed, stepped first accommodation hole 1*a*. A cylinder 6 for guiding the reciprocating motion of the plunger 2 is press-fitted into the middle diameter portion of the first accommodation hole 1*a* on the outer peripheral side thereof, and forms a part of the pressurizing chamber 11 together with the pump body 1. The cylinder 6 is pressed toward the pressurizing chamber 11 by a fixing portion if in which a part of the pump body 1 is deformed to the inner peripheral side, and an end surface 6*b* on the pressurizing chamber 11 side (the upper side in FIGS. 2 and 4) is pressed against the wall surface of the first accommodation hole 1*a* of the pump body 1, so that the fuel pressurized in the pressurizing chamber 11 is sealed not to leak to the low pressure side.

The plunger 2 has a large-diameter portion 2*a* that slides on the cylinder 6, and a small-diameter portion 2*b* that extends from the large-diameter portion 2*a* to the side opposite to the pressurizing chamber 11. A tappet 3 is provided on the tip side (the lower end side in FIGS. 2 and 4) of the small-diameter portion 2*b* of the plunger 2. The tappet 3 converts the rotational motion of a cam 81 (cam mechanism) attached to a cam shaft (not illustrated) of the engine into a linear reciprocating motion and transmits the motion to the plunger 2. The plunger 2 is pressed against the tappet 3 by the urging force of the spring 4 via a retainer 15. With this configuration, the plunger 2 can make a reciprocating motion according to the rotation motion of the cam 81.

A seal holder 7 is press-fitted and fixed to the large-diameter portion of the first accommodation hole 1*a* of the pump body 1. Inside the seal holder 7, there is formed a sub-chamber 7*a* for storing the fuel leaking from the pressurizing chamber 11 via a sliding portion between the plunger 2 and the cylinder 6.

A plunger seal 13 is provided on the small-diameter portion 2*b* of the plunger 2. The plunger seal 13 is held at the inner peripheral end of the seal holder 7 on the cam 81 side so as to be able to slide on the outer peripheral surface of the small-diameter portion 2*b*. The plunger seal 13 seals the fuel in the sub-chamber 7*a* and prevents the fuel from flowing into the engine when the plunger 2 reciprocates. At the same time, the lubricating oil (including the engine oil) in the engine is prevented from flowing into the pump body 1 from the engine side.

In addition, as illustrated in FIGS. 3 and 4, a suction joint 51 is attached to a side surface of the pump body 1. The suction pipe 28 (see FIG. 1) is connected to the suction joint 51, and the fuel from the fuel tank 20 (see FIG. 1) is supplied to the inside of the high-pressure fuel supply pump through the low-pressure fuel suction port 10*a* of the suction joint 51. A suction filter 52 is attached downstream of the low-pressure fuel suction port 10*a*. The suction filter 52 has a function of preventing foreign substances existing between the fuel tank 20 (see FIG. 1) and the pump body 1 from being absorbed into the high-pressure fuel pump by the flow of the fuel.

As illustrated in FIGS. 2 and 3, the pump body 1 is provided with an electromagnetic suction valve mechanism 300 for supplying fuel to the pressurizing chamber 11. As illustrated in FIG. 5, the structure of the electromagnetic suction valve mechanism 300 is roughly classified into a suction valve portion mainly configured by the suction valve 30, a solenoid mechanism mainly configured by a rod 35 and an anchor 36, and a coil portion mainly configured by an electromagnetic coil 43.

The suction valve portion includes the suction valve 30, a suction valve housing 31, a suction valve stopper 32, and a suction valve urging spring 33. The suction valve housing 31 includes, for example, a cylindrical valve housing portion 31*h* that houses the suction valve 30 on one side (the right side in FIG. 5), and an annular suction valve seat portion 31*a* that protrudes on the inner peripheral side of the valve housing portion 31*h*. The suction valve housing 31 is formed integrally with a rod guide 37 described later. The suction valve housing 31 is provided with a plurality of suction ports 31*b* radially communicating with the suction passage (low-pressure fuel flow path) 10*d*. The suction valve stopper 32 is press-fitted and fixed to the valve housing portion 31*h*. The suction valve 30 closes by abutting on the suction valve seat portion 31*a*, and abuts on the suction valve stopper 32 when the valve is open. The suction valve urging spring 33 is disposed between the suction valve 30 and the suction valve stopper 32, and urges the suction valve 30 in the valve closing direction.

The solenoid mechanism includes the rod 35 and the anchor 36 that are movable parts, the rod guide 37, an outer core 38, and a fixed core 39 that are fixing portion, a rod urging spring 40, and an anchor portion urging spring 41.

The rod 35 is slidably held in the axial direction on the inner peripheral side of the rod guide 37. The rod 35 has a tip end on one side (the right side in FIG. 5) that can be brought into contact with and separated from the suction valve 30, and has a rod flange 35*a* at an end on the other side (the left side in FIG. 5). The inner peripheral side of the anchor portion 36 slidably holds the rod 35. In other words, the rod 35 and the anchor portion 36 are configured to be slidable in the axial direction within a geographically restricted range. The anchor portion 36 has a through hole

36*a* that penetrates in the axial direction, thereby minimizing the restriction of the movement of the anchor portion 36 due to the pressure difference between both sides in the axial direction.

The rod guide 37 has a cylindrical central bearing portion 37*b*, and guides the reciprocating operation of the rod 35. The rod guide 37 is provided with a through hole 37*a* penetrating in the axial direction, so that the movement of the anchor portion 36 is not hindered by the pressure in the chamber accommodating the anchor portion 36. The rod guide 37 is press-fitted on the inner peripheral side of one side (the right side in FIG. 5) of the outer core 38 in the axial direction. The anchor portion 36 is slidably disposed on the inner peripheral side on the other side in the axial direction (the left side in FIG. 5). The fixed core 39 is disposed such that the end surface on one side (the right side in FIG. 5) faces the end surface on the rod flange 35*a* side of the anchor portion 36. One end surface of the fixed core 39 and the end surface of the anchor portion 36 facing the one end surface form a magnetic attraction surface S which a magnetic attractive force acts therebetween. When the suction valves 30 are in the open state, they face each other via a magnetic gap.

The rod urging spring 40 is disposed between the fixed core 39 and the rod flange 35*a*. The rod urging spring 40 applies an urging force in the valve opening direction of the suction valve 30, and is set so as to be an urging force for keeping the suction valve 30 open when the electromagnetic coil 43 is not energized. The anchor portion urging spring 41 is disposed such that one end thereof is inserted into the central bearing portion 37*b* of the rod guide 37, and applies an urging force to the anchor part 36 toward the rod flange 35*a*.

The coil portion includes a first yoke 42, the electromagnetic coil 43, a second yoke 44, a bobbin 45, and a connector 47 having a terminal 46 (see FIG. 2). The electromagnetic coil 43 is formed by winding a copper wire around the outer periphery of the bobbin 45, and is assembled on the outer peripheral side of the fixed core 39 and the outer core 38 in a state surrounded by the first yoke 42 and the second yoke 44. The first yoke 42 has its hole fixed to the outer peripheral side of the outer core 38. The second yoke 44 is configured such that the outer peripheral side is fixed to the inner peripheral side of the first yoke 42, and the inner peripheral side is close to the outer periphery of the fixed core 39 with a clearance.

In the above configuration, the outer core 38, the first yoke 42, the second yoke 44, the fixed core 39, and the anchor 36 form a magnetic circuit. In this magnetic circuit, when a current is applied to the electromagnetic coil 43, a magnetic attractive force is generated between the fixed core 39 and the anchor portion 36, and a force for attracting each other is generated.

In addition, on the outlet side of the pressurizing chamber 11 of the pump body 1, the discharge valve mechanism 8 is provided as illustrated in FIG. 3. The discharge valve mechanism 8 is configured by a discharge valve seat 8*a*, a discharge valve 8*b* which comes into contact with or separates from the discharge valve seat 8*a*, a discharge valve spring 8*c* which urges the discharge valve 8*b* toward the discharge valve seat 8*a*, and a discharge valve stopper 8*d* which determines a stroke (moving distance) of the discharge valve 8*b*. The discharge valve stopper 8*d* is held by a plug 8*e*. By connecting the plug 8*e* to the pump body 1 by welding at a contact portion 8*f*, leakage of fuel to the outside is blocked. A discharge valve chamber 12*a* is formed on the secondary side of the discharge valve 8*b*.

In a state where there is no difference in fuel pressure between the pressurizing chamber 11 and the discharge valve chamber 12*a*, the discharge valve 8*b* is tightly pressed to the discharge valve seat 8*a* by the urging force of the discharge valve spring 8*c*, and enters a closed state. When the fuel pressure of the pressurizing chamber 11 becomes larger than that of the discharge valve chamber 12*a*, first the discharge valve 8*b* is opened against the urging force of the discharge valve spring 8*c*. When the discharge valve 8*b* is opened, the high-pressure fuel in the pressurizing chamber 11 is discharged to the common rail 23 (see FIG. 1) through the discharge valve chamber 12*a*, a fuel discharge passage 12*b* described below, and a fuel discharge port 12 described below.

When being opened, the discharge valve 8*b* comes into contact with the discharge valve stopper 8*d*, and the stroke is restricted. Therefore, the stroke of the discharge valve 8*b* is appropriately determined by the discharge valve stopper 8*d*. With this configuration, it is possible to prevent that the stroke becomes so large to delay the close of the discharge valve 8*b* and thus the fuel discharged at a high pressure to the discharge valve chamber 12*a* flows back into the pressurizing chamber 11. Therefore, deterioration in efficiency of the high-pressure fuel supply pump can be suppressed. In addition, when the discharge valve 8*b* repeatedly opens and closes, the discharge valve 8*b* is guided by the outer peripheral surface of the discharge valve stopper 8*d* so as to move only in the stroke direction. With the above configuration, the discharge valve mechanism 8 functions as a check valve that restricts the direction of fuel flow.

Further, the pressurizing chamber 11 is configured by the pump body 1 (pump housing), the electromagnetic suction valve mechanism 300, the plunger 2, the cylinder 6, and the discharge valve mechanism 8.

In addition, as illustrated in FIGS. 2 and 3, a discharge joint 60 is attached to the pump body 1 at a position opposite to the electromagnetic suction valve mechanism 300.

The discharge joint 60 has the fuel discharge port 12 formed therein, and the fuel discharge port 12 communicates with the discharge valve chamber 12*a* via the fuel discharge passage 12*b*. The discharge joint 60 is configured to house the relief valve mechanism 200 therein.

The relief valve mechanism 200 includes a relief body 201, a relief valve seat 202, a relief valve 203, a relief valve holder 204, and a relief spring 205. After the relief spring 205, the relief valve holder 204, and the relief valve 203 are inserted in this order in the relief body 201, the relief valve seat 202 is press-fitted and fixed. One end of the relief spring 205 is in contact with the relief body 201, and the other end is in contact with the relief valve holder 204. The relief valve 203 shuts off the fuel by the urging force of the relief spring 204 acting via the relief valve holder 204 and being pressed by the relief valve seat 202. The valve opening pressure of the relief valve 203 is determined by the urging force of the relief spring 205. The relief valve mechanism 200 communicates with the pressurizing chamber 11 via a relief passage 210.

In addition, as illustrated in FIGS. 2 and 4, a concave portion 1*p* is provided on the tip end side (the upper end side in FIGS. 2 and 4) of the pump body 1. A cylindrical-bottomed damper cover 14 (cup shape) is fixed to the pump body 1 by welding so as to cover the concave portion 1*p*. A low-pressure fuel chamber 10 is formed by the concave portion 1*p* of the pump body 1 and the damper cover 14. The low-pressure fuel chamber 10 communicates with the low-pressure fuel suction port 10*a* and also communicates with the suction port 31*b* of the electromagnetic suction valve mechanism 300 via the suction passage 10*d*. That is, the low-pressure fuel chamber is formed upstream of the pressurizing chamber 11. In addition, the low-pressure fuel chamber 10 communicates with the sub-chamber 7*a* via a fuel passage 10*e*.

In the low-pressure fuel chamber 10, the metal damper 9 is disposed. That is, the pump body 1 and the damper cover 14 form a damper chamber that houses the metal damper 9. The metal damper 9 is held in the low-pressure fuel chamber (damper chamber) 10 while being interposed between a first holding member 9*a* and a second holding member 9*b*.

The first holding member 9*a* is disposed between the damper cover 14 and the metal damper 9 in the low-pressure fuel chamber (damper chamber) 10, and presses and holds the metal damper 9 from one side (the upper side in FIGS. 2 and 4). The second holding member 9*b* is disposed in the low-pressure fuel chamber (damper chamber) 10 on the opposite side of the first holding member 9*a* across the metal damper 9 (between the pump body 1 and the metal damper 9), and presses and holds the metal damper 9 from the other side (the lower side in FIGS. 2 and 4).

Figure 6:
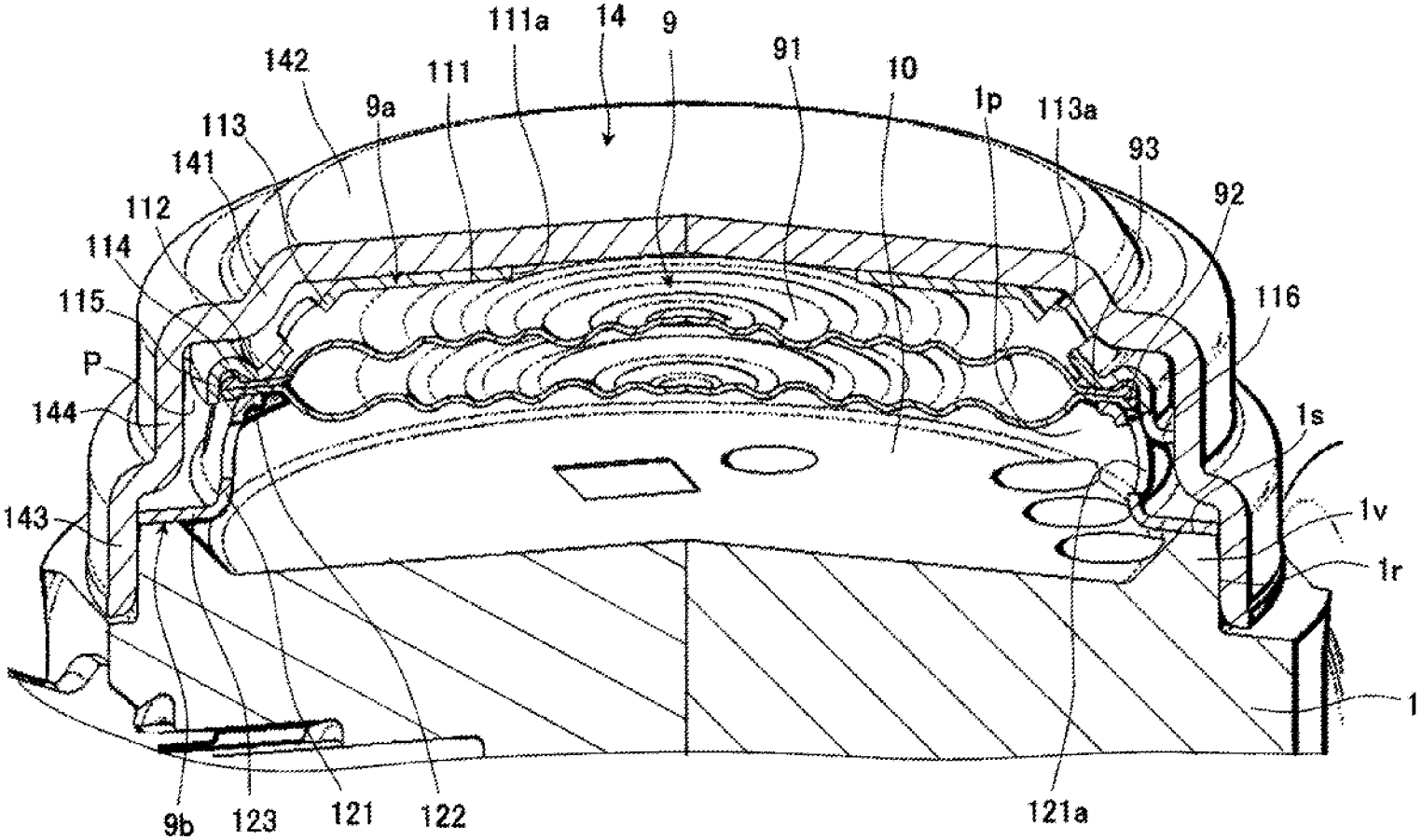
FIG. 6 is an enlarged perspective view illustrating a cut-away state of a metal damper and a holding structure thereof that form a part of the high-pressure fuel supply pump according to the first embodiment of the invention.
Figure 7:
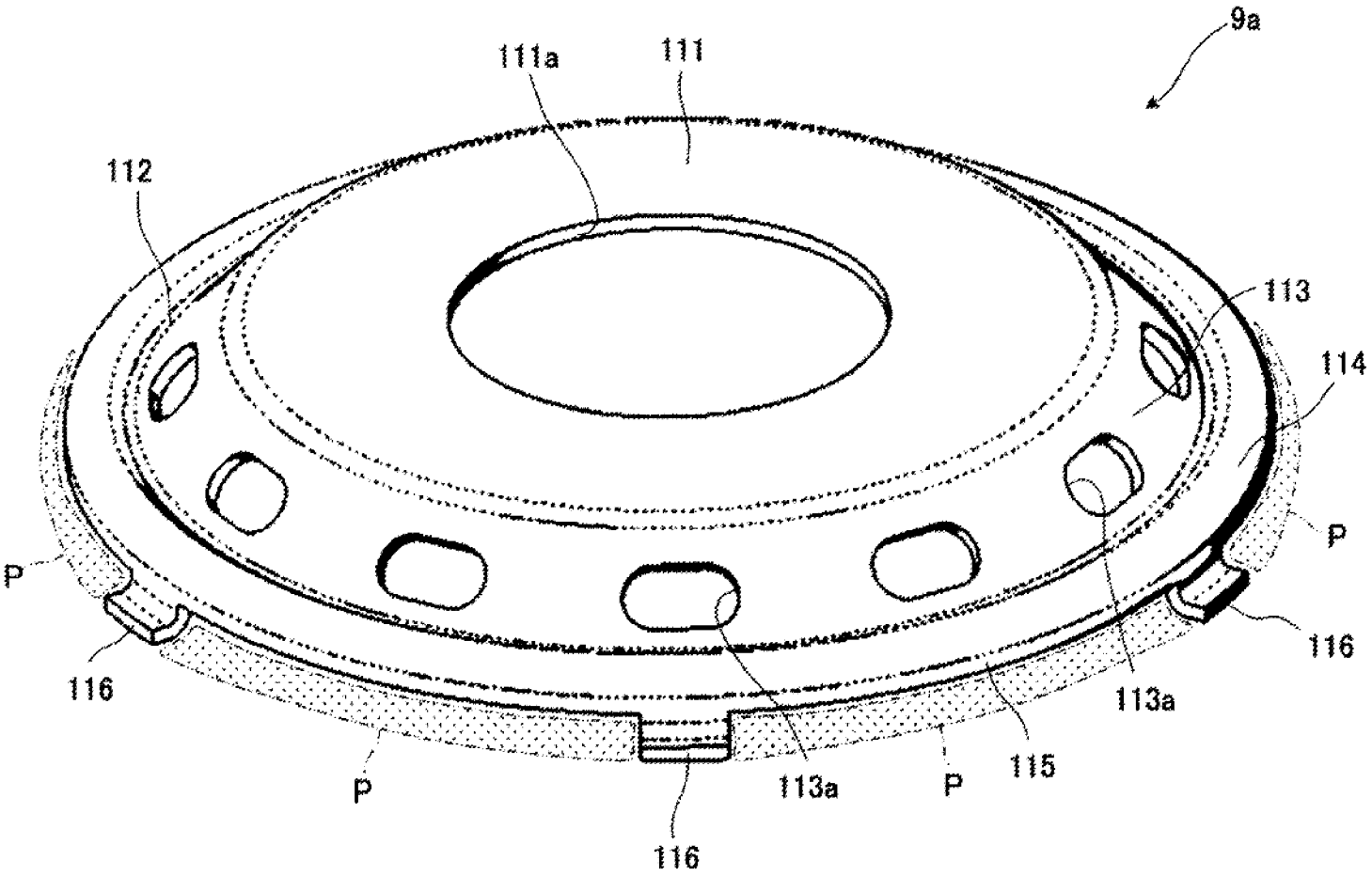
FIG. 7 is a perspective view illustrating a first holding member that forms a part of the high-pressure fuel supply pump according to the first embodiment of the invention illustrated in FIG. 6.

(Details of Metal Damper and Holding Structure of Metal Damper) Next, details of the configuration and structure of the metal damper and components for holding the metal damper will be described with reference to FIGS. 6 and 7. FIG. 6 is an enlarged perspective view illustrating a cutaway state of a metal damper and a holding structure thereof that form a part of the high-pressure fuel supply pump according to the first embodiment of the invention. FIG. 7 is a perspective view illustrating a first holding member that forms a part of the high-pressure fuel supply pump according to the first embodiment of the invention illustrated in FIG. 6.

In FIG. 6, for example, the metal damper 9 is formed by welding all over the periphery of two corrugated disk-shaped metal diaphragms at their peripheral edges, and sealing an inert gas such as argon to an internal space formed between the two laminated diaphragms. In other words, the metal damper 9 is configured by a substantially circular main body portion 91 having an internal space in which an inert gas is sealed, a welding portion 92 formed in a peripheral portion, and an annular and flat plate portion 93 extending between the main body portion 91 and the welding portion 92. The flat plate portion 93 is a portion where the planar portions of the two metal diaphragms overlap, and is located radially inward of the welding portion 92. The metal damper 9 reduces pressure pulsation by increasing or decreasing the volume of the internal space of the main body portion 91 due to pressure acting on both surfaces.

The concave portion 1*p* of the pump body 1 is formed in a truncated cone shape whose diameter on the opening side is enlarged. At the end of the pump body 1 on the concave portion 1*p* side, an outer peripheral surface 1*r* is formed in a cylindrical shape, and the end surface 1*s* is formed in an annular shape. In other words, an annular protrusion 1*v* is formed at the end of the pump body 1 on the concave portion 1*p* side. The end of the pump body 1 on the side of the concave portion 1*p* and the concave portion 1*p* have a rotationally symmetric shape.

The damper cover 14, for example, is formed in a stepped cylindrical shape (cup shape) with one side closed and is formed in a rotationally symmetric shape, and is configured to accommodate three components: the first holding member 9*a*, the metal damper 9, and the second holding member 9*b*. Specifically, the damper cover 14 is configured by a cylindrical small-diameter cylindrical portion 141, a circular closing portion 142 that closes one side of the small-diameter cylindrical portion 141, a cylindrical large-diameter cylindrical portion 143 on the opening side, and a cylindrical medium-diameter cylindrical portion 144 located between the small-diameter cylindrical portion 141 and the large-diameter cylindrical portion 143. The damper cover 14 is formed, for example, by pressing a steel plate. The large-diameter cylindrical portion 143 of the damper cover 14 is press-fitted into the outer peripheral surface 1*r* at the end of the pump body 1 on the concave portion 1*p* side and fixed by welding. By providing a plurality of steps in the cylindrical portion of the damper cover 14, the tip end (small-diameter cylindrical portion 141) can be reduced in size with respect to the portion (large-diameter cylindrical portion 143) attached to the pump body 1, and this is advantageous when the installation space for the high-pressure fuel supply pump is narrow.

The first holding member 9*a* is, for example, an elastic body having a bottomed cylindrical shape (cup shape) and rotationally symmetrical shape as illustrated in FIGS. 6 and 7. Specifically, the first holding member 9*a* includes a contact portion 111 that abuts on the damper cover 14, an annular pressing portion 112 that presses the flat plate portion 93 of the metal damper 9 over the entire circumference, a cylindrical first side wall surface portion 113 which connects the contact portion 111 and the pressing portion 112 and increases its diameter from the contact portion 111 toward the pressing portion 112, an annular curved portion 114 that protrudes radially outward from the entire periphery of the pressing portion 112 to be bent to receive a part of the welding portion 92 of the metal damper 9, and a cylindrical enclosing portion 115 that extends in the axial direction from the curved portion 114 and surrounds the peripheral edge of the metal damper 9. The first holding member 9*a* is formed, for example, by pressing a steel plate.

The contact portion 111 is formed in a circular and planar shape. A first communication hole 111*a* is provided at the center of the contact portion 111. In this embodiment, a configuration in which the first communication hole 111*a* is not provided is also possible. However, the first communication hole 111*a* is a structure necessary when applied to a modification of the first embodiment described later, and is provided for the purpose of sharing components. Further, the details of the first communication hole 111*a* will be described in the description of the modification.

In the first side wall surface portion 113, a plurality of second communication holes 113*a* are provided at intervals in the circumferential direction. The second communication hole 113*a* is a communication passage that communicates with a space (a space surrounded by the first holding member 9*a* and the metal damper 9) formed radially inside the cylindrical first side wall surface portion 113 and a space (a space surrounded by the first holding member 9*a* and the damper cover 14) formed outside in the radial direction of the first side wall surface portion 113, and functions as a flow path that allows the fuel in the low-pressure fuel chamber (damper chamber) 10 to circulate to both surfaces of the main body portion 91 of the metal damper 9.

The enclosing portion 115 is set so that the inner diameter thereof has a gap (first gap) within a predetermined range than the outer diameter of the metal damper 9, and functions as a first regulation portion that regulates movement of the metal damper 9 in the radial direction. The first gap between the inner peripheral surface of the enclosing portion 115 and the peripheral edge of the metal damper 9 is set in a range where the pressing portion 112 of the first holding member 9*a* does not abut on the welding portion 92 of the metal damper 9 even if the metal damper 9 is radially displaced from the first holding member 9*a* by the first gap.

A plurality of projections 116 projecting outward in the radial direction are provided at the opening-side end of the enclosing portion 115 at intervals in the circumferential direction. The plurality of projections 116 are configured to face the inner peripheral surface of the medium-diameter cylindrical portion 144 of the damper cover 14 with a gap (second gap) within a predetermined range, and functions as a second regulation portion that regulates movement of the first holding member 9*a* in the radial direction in the low-pressure fuel chamber (damper chamber) 10. In other words, the plurality of projections 116 have a function of centering the first holding member 9*a* in the damper cover 14. In order to sufficiently exhibit the centering function, it is desirable to provide six or more projections 116. The second gap between the tip of each projection 116 and the inner peripheral surface of the medium-diameter cylindrical portion 144 of the damper cover 14 is set in a range where the pressing portion 112 of the first holding member 9*a* does not abut on the welding portion 92 of the metal damper 9 even if the first holding member 9*a* is displaced in the radial direction with respect to the damper cover 14 by the second gap.

Each projection 116 is formed, for example, by cutting and raising, and a space P extending in the circumferential direction is formed between adjacent projections 116. This space P forms a communication path for communicating the space on one side (upper side in FIG. 6) of the metal damper 9 with the space on the other side (lower side in FIG. 6), and functions as a flow path that allows the fuel in the low-pressure fuel chamber (damper chamber) 10 to circulate to both surfaces of the main body portion 91 of the metal damper 9. The length of each of the projections 116 can be set to be short as long as cutting and raising is possible. Even in a case where the length of the projections 116 is made as short as possible, the space P as a flow path can be always secured between the adjacent projections 116, so that the first holding member 9*a* can be minimized in the radial direction.

The second holding member 9*b* is, for example, an elastic body having a cylindrical and rotationally symmetric shape as illustrated in FIG. 6 (see also FIG. 8 described later). Specifically, the second holding member 9*b* is configured by a cylindrical second side wall surface portion 121 whose one side expands in diameter, and an annular pressing portion 122 bent radially inward from an opening end on the small diameter side of the second side wall surface portion 121, and an annular flange portion 123 protruding radially outward from an opening end on the large diameter side of the second side wall surface portion 121. The second holding member 9*b* is formed, for example, by pressing a steel plate.

In the second side wall surface portion 121, a plurality of third communication holes 121*a* are provided at intervals in the circumferential direction. The third communication hole 121*a* is a communication passage that communicates with a space (a space surrounded by the second holding member 9*b*, the metal damper 9, and the concave portion 1*p* of the pump body 1) formed radially inside the cylindrical second side wall surface portion 121 and a space (a space surrounded by the second holding member 9*b* and the damper cover 14) formed outside in the radial direction of the second side wall surface portion 121, and functions as a flow path that allows the fuel in the low-pressure fuel chamber (damper chamber) 10 to circulate to both surfaces of the main body portion 91 of the metal damper 9.

The pressing portion 122 is configured to press the flat plate portion 93 of the metal damper 9 over the entire circumference, and is formed to have substantially the same diameter as the pressing portion 122 of the first holding member 9*a*. That is, the pressing portion 122 of the second holding member 9*b* and the pressing portion 112 of the first holding member 9*a* are configured to interpose both surfaces of the flat plate portion 93 of the metal damper 9 in the same manner.

The flange portion 123 is configured to abut on the end surface is of the pump body 1 on the side of the concave portion 1*p*. In addition, the flange portion 123 is configured to face the inner peripheral surface of the large-diameter cylindrical portion 143 of the damper cover 14 with a gap (third gap) within a predetermined range, and functions as a third regulation portion that regulates movement of the second holding member 9*b* in the low-pressure fuel chamber (damper chamber) 10 in the radial direction. In other words, the flange portion 123 has a function of centering the second holding member 9*b* inside the damper cover 14. The third gap between the outer peripheral edge of the flange portion 123 and the inner peripheral surface of the large-diameter cylindrical portion 143 of the damper cover 14 is set in a range where the pressing portion 122 of the second holding member 9*b* does not abut on the welding portion 92 of the metal damper 9 even if the second holding member 9*b* is displaced in the radial direction with respect to the damper cover 14 by the third gap.

As described above, in the holding structure of the metal damper 9 according to this embodiment, the space P between the second communication hole 113*a* of the first side wall surface portion 113 of the first holding member 9*a* and the adjacent projection 116 of the first holding member 9*a*, and the third communication hole 121*a* of the second side wall surface portion 121 of the second holding member 9*b* serve as a flow path which allows the fuel in the low-pressure fuel chamber (damper chamber) 10 to circulate to both surfaces of the metal damper 9. Therefore, it is not necessary to provide the flow path in the pump body 1, and the shape of the pump body 1 and the concave portion 1*p* of the pump body 1 can be simplified to a rotationally symmetric shape. In this case, the processing of the flow path for the pump body 1 is unnecessary, and the processing of the pump body 1 and the concave portion 1*p* of the pump body 1 becomes easy. Therefore, the manufacturing cost of the high-pressure fuel supply pump can be reduced.

In addition, in the holding structure of the metal damper 9 according to this embodiment, as described above, the second communication hole 113*a* of the first holding member 9*a*, the space P between the adjacent projections 116, and the third communication hole 121*a* of the second holding member 9*b* serve as a flow path that allows the fuel in the low-pressure fuel chamber (damper chamber) 10 to circulate to both surfaces of the metal damper 9. For this reason, the damper cover 14 does not need to have a complicated shape for securing the flow path, and can be simplified to a rotationally symmetric shape.

In this case, the processing of the damper cover 14 becomes easy, and the manufacturing cost of the high-pressure fuel supply pump can be reduced.

In addition, in the holding structure of the metal damper 9 according to this embodiment, the radial positioning (centering) of the first holding member 9*a*, the metal damper 9, and the second holding member 9*b* in the damper cover 14, is performed by the enclosing portion 115 of the first holding member 9*a*, the projection 116, and the flange portion 123 of the second holding member 9*b*.

Therefore, it is not necessary to provide the pump body with a structure for positioning (centering) the first holding member 9*a*, the metal damper 9, and the second holding member 9*b*. Therefore, it is possible to avoid complication of the shape of the pump body 1, and to simplify the shape of the pump body 1 and the concave portion 1*p* of the pump body 1 to a rotationally symmetric shape. In this case, the processing of the pump body 1 becomes easy, and the manufacturing cost of the high-pressure fuel supply pump can be reduced.

(Step for Assembling Metal Damper) Next, the step for assembling the metal damper in the high-pressure fuel supply pump according to the first embodiment of the invention will be described with reference to FIG. 8. FIG. 8 is an explanatory view illustrating the step for assembling the metal damper in the high-pressure fuel supply pump according to the first embodiment of the invention.

Figure 8:
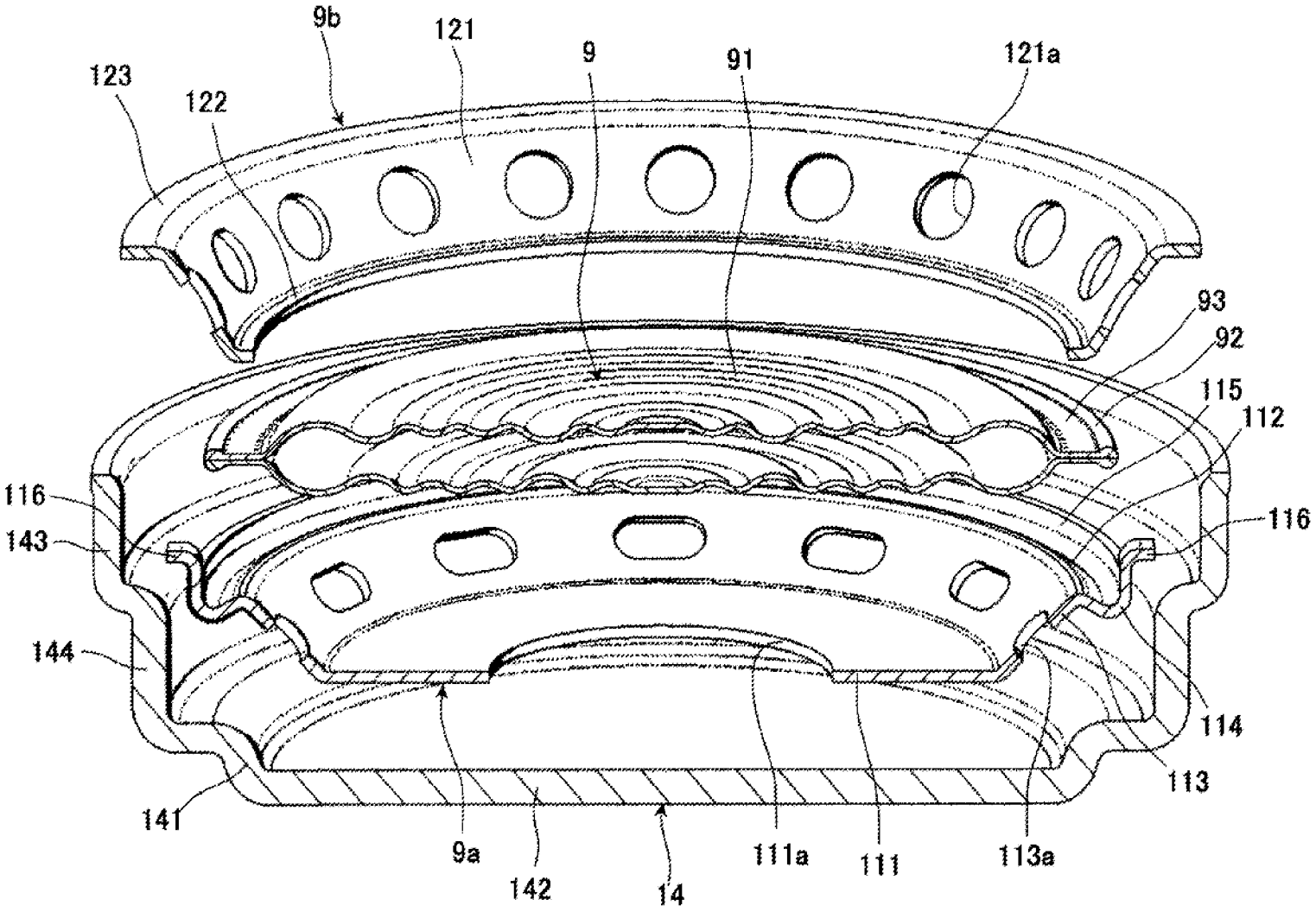
FIG. 8 is an explanatory view illustrating a step for assembling the metal damper in the high-pressure fuel supply pump according to the first embodiment of the invention.

First, as illustrated in FIG. 8, the damper cover 14 is disposed such that the closing portion 142 is on the lower side and the opening is on the upper side.

Next, the first holding member 9*a* is inserted into the damper cover 14 with the contact portion 111 facing downward, and placed on the closing portion 142 of the damper cover 14. At this time, the first holding member 9*a* is positioned in the damper cover 14 in the radial direction by the plurality of projections 116 of the first holding member 9*a*. That is, the centering of the first holding member 9*a* in the damper cover 14 is performed only by inserting the first holding member 9*a* into the damper cover 14. In this embodiment, since the second gap is provided between the projection 116 of the first holding member 9*a* and the inner peripheral surface of the medium-diameter cylindrical portion 144 of the damper cover 14, the first holding member 9*a* is easily assembled to the damper cover 14.

Next, the metal damper 9 is placed on the pressing portion 112 of the first holding member 9*a* in the damper cover 14. At this time, the metal damper 9 is positioned in the radial direction in the first holding member 9*a* by the enclosing portion 115 of the first holding member 9*a*.

In this case, since the first holding member 9*a* is centered in the damper cover 14, the metal damper 9 is simply placed on the first holding member 9*a*, so that the metal damper 9 is centered in the damper cover 14. In this embodiment, since the first gap is provided between the inner peripheral surface of the enclosing portion 115 of the first holding member 9*a* and the peripheral edge of the metal damper 9, the first gap is easily assembled to the first holding member 9*a* of the metal damper 9.

Subsequently, the second holding member 9*b* is inserted into the damper cover 14 with the pressing portion 122 facing downward, and placed on the flat plate portion 93 of the metal damper 9. At this time, the second holding member 9*b* is positioned in the damper cover 14 in the radial direction by its own flange portion 123. That is, the centering of the second holding member 9*b* in the damper cover 14 is performed only by inserting the second holding member 9*b* into the damper cover 14. In this embodiment, since the third gap is provided between the outer edge of the flange portion 123 of the second holding member 9*b* and the inner peripheral surface of the large-diameter cylindrical portion 143 of the damper cover 14, the second holding member 9*b* is easily assembled to the damper cover 14.

Finally, the end of the pump body 1 (see FIG. 6) on the concave portion 1*p* side is press-fitted into the large-diameter cylindrical portion 143 of the damper cover 14, and the end surface is of the pump body 1 on the concave portion 1*p* side presses the flange portion 123 of the second holding member 9*b*. In this state, the damper cover 14 is fixed to the pump body 1 by welding.

In this case, the flange portion 123 and the second side wall surface portion 121 of the second holding member 9*b* are in a state of being elastically bent. In addition, the contact portion 111 of the first holding member 9*a* is pressed by the closing portion 142 of the damper cover 14, and the second side wall surface portion 121 of the first holding member 9*a* is elastically bent. As a result, a spring reaction force is generated in the first holding member 9*a* and the second holding member 9*b*, and the metal damper 9 is reliably held in the low-pressure fuel chamber (damper chamber) 10 by the urging force.

As described above, in the step for assembling the metal damper 9 in this embodiment, the first holding member 9*a*, the metal damper 9, and the second holding member 9*b* can be positioned (centered) in the damper cover 14 only by sequentially inserting the first holding member 9*a*, the metal damper 9, and the second holding member 9*b* into the damper cover 14. Therefore, the step for positioning each of the components 9, 9*a*, and 9*b* is not required.

In addition, since it is not necessary to unitize the three components of the first holding member 9*a*, the metal damper 9, and the second holding member 9*b* and assemble them into the damper cover 14, a subassembly step for unitizing the components 9, 9*a*, and 9*b* is not necessary.

Further, since the damper cover 14, the first holding member 9*a*, the metal damper 9, and the second holding member 9*b* are each formed in a rotationally symmetric shape, only the axial direction of the component needs to be considered when assembling.

Therefore, it is possible to improve productivity and reduce costs by simplifying the assembly process.

(Operation of High-Pressure Fuel Supply Pump) Next, the operation of the high-pressure fuel supply pump will be described with reference to FIGS. 2 to 6.

When the plunger 2 moves toward the cam 81 and enters a suction stroke state while the cam 81 rotates illustrated in FIG. 2, the volume of the pressurizing chamber 11 is increased, and the fuel pressure in the pressurizing chamber 11 is lowered. If the fuel pressure in the pressurizing chamber 11 is lowered than the pressure of the suction port 31*b* in this stroke, the suction valve 30 enters an open state. Therefore, as illustrated in FIG. 5, the fuel passes through an opening 30*e* of the suction valve 30, and flows to the pressurizing chamber 11.

After the end of the suction stroke, the plunger 2 moves up to the compression stroke. Here, the electromagnetic coil 43 is kept in the non-energized state, and no magnetic urging force is generated. In this case, the suction valve 30 is maintained in the open state by the urging force of the rod urging spring 40. The volume of the pressurizing chamber 11 is reduced according to the compression movement of the plunger 2. However, in a state where the suction valve 30 is opened, the fuel once sucked into the pressurizing chamber 11 returns to the suction passage 10*d* through the opening 30*e* of the suction valve 30. Therefore, the pressure of the pressurizing chamber 11 is not increased. This stroke is called a returning stroke.

In this state, when the control signal of the ECU 27 (see FIG. 1) is applied to the electromagnetic suction valve mechanism 300, a current flows through the electromagnetic coil 43 via the terminal 46 (see FIG. 2). Then, the magnetic attractive force operates between the fixed core 39 and the anchor 36, so that the magnetic urging force overcomes the urging force of the rod urging spring 40 to make the rod 35 move in a direction away from the suction valve 30. Therefore, the suction valve 30 is closed by the urging force of the suction valve urging spring 33 and the fluid force caused by the fuel flowing into the suction passage 10*d*. By closing the suction valve 30, the fuel pressure in the pressurizing chamber 11 rises in accordance with the rising motion of the plunger 2, and when the pressure becomes equal to or higher than the pressure of the fuel discharge port 12, the discharge valve 8*b* of the discharge valve mechanism 8 illustrated in FIG. 3 opens. Thereby, the high-pressure fuel in the pressurizing chamber 11 is discharged from the fuel discharge port 12 through the discharge valve chamber 12*a* and the fuel discharge passage 12*b*, and is supplied to the common rail 23 (see FIG. 1). This stroke is called a discharge stroke.

In other words, the compression stroke of the plunger 2 illustrated in FIG. 2 (the upward stroke from the lower start point to the upper start point) includes the returning stroke and the discharge stroke. In addition, the flow rate of the discharging high-pressure fuel can be controlled by controlling timing for energizing the electromagnetic coil 43 of the electromagnetic suction valve mechanism 300. If the timing for energizing the electromagnetic coil 43 is set to be advanced, the ratio of the returning stroke in the compression stroke becomes small, and the ratio of the discharge stroke becomes large. In other words, the fuel returning to the suction passage 10*d* becomes less, and on the other hand the discharged high-pressure fuel becomes large. On the other hand, if the energization timing is delayed, the ratio of the returning stroke during the compression stroke increases, and the ratio of the discharge stroke decreases. In other words, the fuel returning to the suction passage 10*d* becomes large, and on the other hand the discharged high-pressure fuel becomes less. The timing for energizing the electromagnetic coil 43 is controlled by a command from the ECU 27.

As described above, it is possible to control the amount of high-pressure fuel to be discharged as much as the engine requires by controlling the timing for energizing the electromagnetic coil 43.

In the above-described pump displacement control, in a case where the fuel once flowing into the pressurizing chamber is returned to the suction passage 10*d* again through the suction valve 30 in the open state (in the case of the returning stroke), the fuel flows back from the pressurizing chamber 11 to the suction passage 10*d*. Therefore, pressure pulsation occurs in the low-pressure fuel chamber 10. The pressure pulsation is transmitted to the surface of the metal damper 9 disposed in the low-pressure fuel chamber (damper chamber) 10 illustrated in FIG. 6 on the pump body 1 side (the lower side in FIG. 6), and transmitted to the surface of the metal damper 9 on the damper cover 14 side (the upper side in FIG. 6) sequentially through the third communication hole 121*a* of the second holding member 9*b*, the space P between the adjacent projections 116 of the first holding member 9*a*, and the second communication hole 113*a* of the first holding member 9*a*. This pressure pulsation is reduced by the expansion and contraction of the main body portion 91 of the metal damper 9.

In addition, as illustrated in FIG. 4, the volume of the sub-chamber 7*a* increases or decreases due to the reciprocating motion of the plunger 2 having the large-diameter portion 2*a* and the small-diameter portion 2*b*. When the plunger 2 moves down, the volume of the sub-chamber 7*a* decreases, and the fuel flows from the sub-chamber 7*a* to the low-pressure fuel chamber via the fuel passage 10*e*. On the other hand, when ascending, the volume of the sub-chamber 7*a* increases, and the fuel flows from the low-pressure fuel chamber 10 to the sub-chamber 7*a* via the fuel passage 10*e*. This makes it possible to reduce the fuel flow into and out of the pump during the suction stroke or the returning stroke of the pump, and reduce pressure pulsation generated inside the pump.

Further, in a case where the pressure of the fuel discharge port 12 becomes larger than the set pressure of the relief valve mechanism 200 due to a failure of the electromagnetic suction valve mechanism 300 illustrated in FIG. 3, the relief valve 203 is opened, and abnormally high-pressure fuel is released to the pressurizing chamber 11 through the relief passage 210.

As described above, according to the high-pressure fuel supply pump according to the first embodiment of the invention, the first holding member 9*a* includes the enclosing portion (first regulation portion) 115 that regulates movement in the radial direction of the metal damper 9 (damper) and the projection (second regulation portion) 116 that regulates movement in the radial direction of the projection 116. The flow path (space P) communicating with the inside of the low-pressure fuel chamber (damper chamber) 10 is formed at the position of the projection (second regulation portion) 116. Therefore, the pump body 1 is not required to position the first holding member 9*a* and the metal damper 9 and to process the flow path. Further, there is no need to secure the flow path by the shape of the damper cover 14. Therefore, the shapes of the components of the pump body 1 and the damper cover 14 can be simplified, and the manufacturing cost of the components 1 and 14 can be reduced.

In addition, the projection (second regulation portion) 116 of the first holding member 9*a* positions the first holding member 9*a* in the radial direction within the damper cover 14, and the enclosing portion (first regulation portion) 115 of the first holding member 9*a* positions the metal damper 9 in the radial direction within the damper cover 14. Therefore, the components 9 and 9*a* are easily centered during assembly.

Further, according to this embodiment, the first holding member 9*a* is configured such that the second gap is formed between the projection 116 of the first holding member 9*a* and the inner peripheral surface of the damper cover 14. Therefore, the holding member 9*a* can be easily assembled into the damper cover 14.

In addition, according to this embodiment, the second gap between the projection 116 of the first holding member 9*a* and the inner peripheral surface of the damper cover 14 is set in a range where the pressing portion 112 of the first holding member 9*a* does not abut on the welding portion 92 of the metal damper 9 even if the first holding member 9*a* moves in the radial direction by the second gap. Therefore, even if the first holding member 9*a* is configured to have a clearance fit with the damper cover 14, the first holding member 9*a* does not press the welding portion 92 of the metal damper 9. Therefore, it is possible to prevent the pressing force of the first holding member 9*a* from acting on the welding portion 92, thereby preventing the welding portion 92 from being damaged such as a crack.

In addition, according to this embodiment, the metal damper 9 is interposed and held by the first holding member 9*a* disposed on one side of the metal damper 9 and the second holding member 9*b* disposed on the other side. Therefore, the metal damper 9 can be firmly held in the low-pressure fuel chamber (damper chamber) 10, and the metal damper 9 can be prevented from being directly held by the pump body 1 and the damper cover 14.

Further, according to this embodiment, since the second holding member 9*b* has the flange portion (third regulation portion) 123 for regulating the movement of the second holding member 9*b* in the radial direction, the second holding member 9*b* is easily positioned in the radial direction within the damper cover 14.

In addition, according to this embodiment, the second holding member 9*b* is configured such that the third gap is formed between the flange portion 123 of the second holding member 9*b* and the inner peripheral surface of the damper cover 14. Therefore, the second holding member 9*b* can be easily assembled into the damper cover 14.

Further, according to this embodiment, the third gap between the flange portion 123 of the second holding member 9*b* and the inner peripheral surface of the damper cover 14 is set in a range where the second holding member 9*b* does not abut on the welding portion 92 of the metal damper 9 even if the second holding member 9*b* moves in the radial direction by the third gap. Therefore, even if the second holding member 9*b* is configured to have a clearance fit with the damper cover 14, the second holding member 9*b* does not press the welding portion 92 of the metal damper 9. Therefore, it is possible to prevent the pressing force of the second holding member 9*b* from acting on the welding portion 92, thereby preventing the welding portion from being damaged such as a crack.

In addition, according to this embodiment, in the cylindrical first side wall surface portion 113 of the first holding member 9*a*, the second communication hole 113*a* is provided to communicate a space formed radially inward of the first side wall surface portion 113 in the low-pressure fuel chamber 10 and a space formed radially outward. Therefore, it is possible to reliably secure a flow path that allows the fuel in the low-pressure fuel chamber 10 to flow on both surfaces of the metal damper 9.

In addition, according to this embodiment, since the enclosing portion 115 as the first regulation portion of the first holding member 9*a* is configured to surround the entire peripheral portion of the metal damper 9, it is possible to make the metal damper 9 of the first regulation portion securely centered.

In addition, according to this embodiment, since the first holding member 9*a* is configured as an elastic body that abuts against the damper cover 14 during assembly, the metal damper 9 can securely be held in the low-pressure fuel chamber (damper chamber) 10 by the spring reaction force of the first holding member 9*a*.

Similarly, according to this embodiment, since the second holding member 9*b* is configured as an elastic body that abuts on the pump body 1 during assembly and is elastically deformed, the metal damper 9 can be securely held in the low-pressure fuel chamber (damper chamber) 10 by the spring reaction force of the second holding member 9*b*.

In addition, according to this embodiment, since the contact portion 111 of the first holding member 9*a* that abuts on the closing portion 142 of the damper cover 14 is formed in a planar shape, the pressing force of the damper cover 14 acting on the contact portion 111 is dispersed, and it is possible to suppress the occurrence of locally large stress in the contact portion 111.

Modification of First Embodiment

Figure 9:
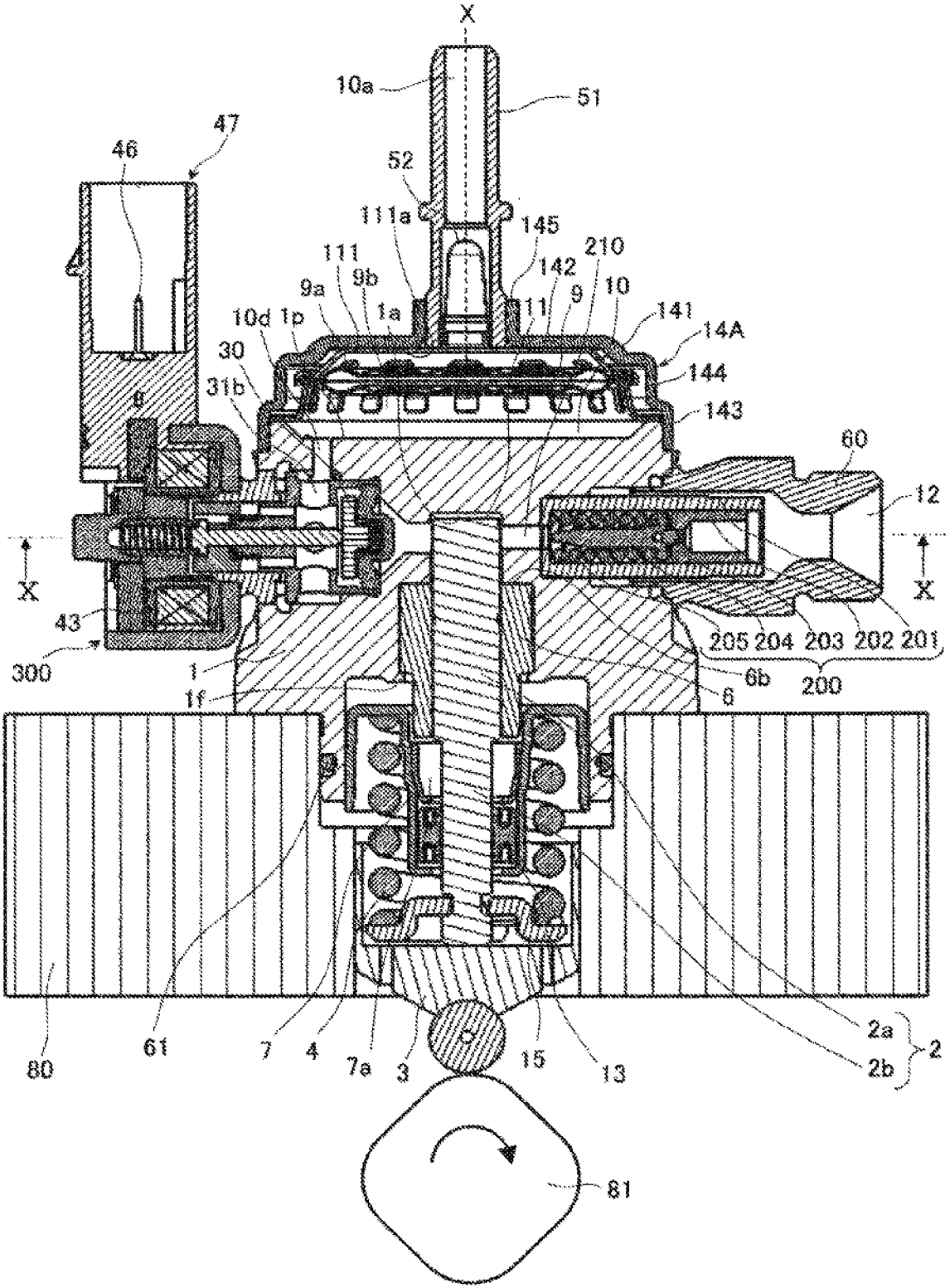
FIG. 9 is a longitudinal cross-sectional view illustrating a high-pressure fuel supply pump according to a modification of the first embodiment of the invention.
Figure 10:
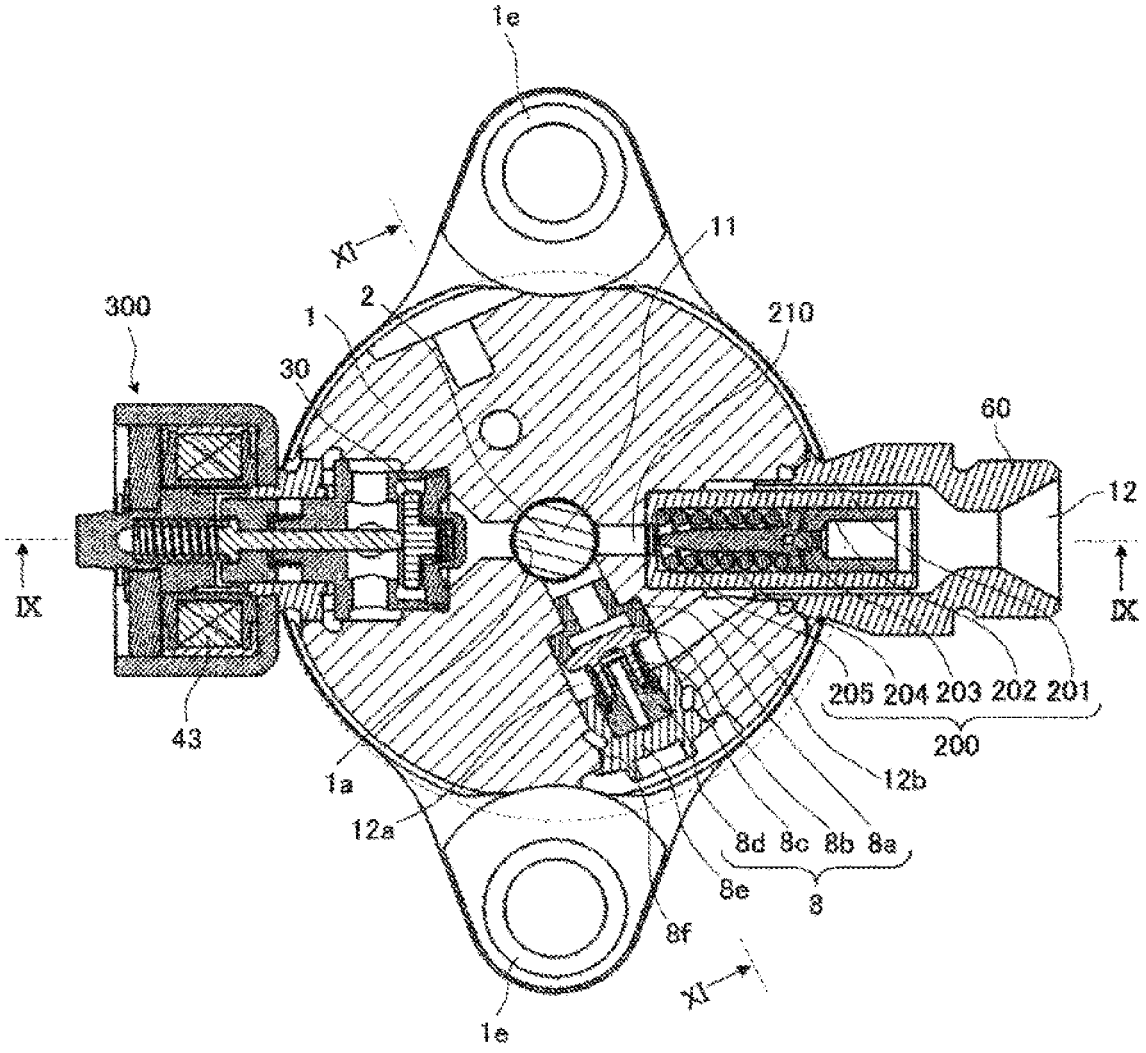
FIG. 10 is a lateral cross-sectional view of a high-pressure fuel supply pump according to a modification of the first embodiment of the invention illustrated in FIG. 9, when viewed from the direction of arrows X-X.
Figure 11:
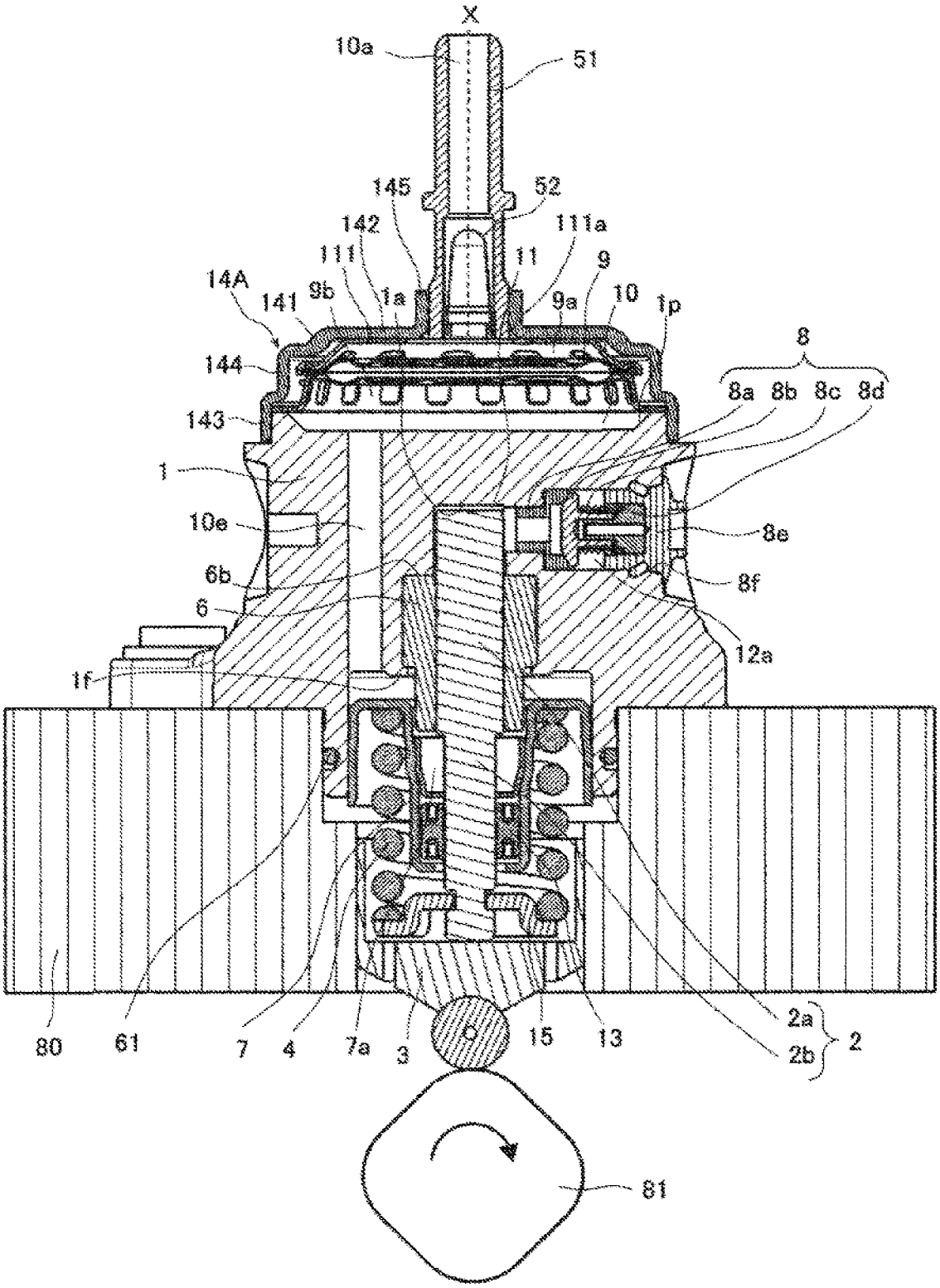
FIG. 11 is a longitudinal cross-sectional view illustrating a state in which a high-pressure fuel supply pump according to a modification of the first embodiment of the invention is cut along a plane (a plane different from FIG. 9) including both axes of a plunger and a discharge valve mechanism.

Next, a high-pressure fuel supply pump according to a modification of the first embodiment of the invention will be described with reference to FIGS. 9 to 11. FIG. 9 is a longitudinal cross-sectional view illustrating the high-pressure fuel supply pump according to the modification of the first embodiment of the invention. FIG. 10 is a lateral cross-sectional view of the high-pressure fuel supply pump according to the modification of the first embodiment of the invention illustrated in FIG. 9, when viewed from the direction of arrows X-X. FIG. 11 is a longitudinal cross-sectional view illustrating a state in which the high-pressure fuel supply pump according to the modification of the first embodiment of the invention is cut along a plane (a plane different from FIG. 9) including the both axes of the plunger and the discharge valve mechanism. Further, in FIGS. 9 to 11, the same reference numerals as those illustrated in FIG. 1 to are the same portions, and a detailed description thereof will be omitted.

The high-pressure fuel supply pump according to the modification of the first embodiment of the invention illustrated in FIGS. 9 to 11 is different from the high-pressure fuel supply pump according to the first embodiment in that the suction joint 51 is mounted to the side surface of the pump body 1 (see FIGS. 3 and 4), and the suction joint 51 is mounted to a damper cover 14A.

Specifically, as illustrated in FIGS. 9 and 11, the damper cover 14A includes a mounting cylinder portion 145 at the center of the closing portion 142. The mounting cylinder portion 145 is formed so as to match with the axis X of the suction joint 51 and the axis of the damper cover 14A. The mounting cylinder portion 145 is formed by, for example, press working. The suction joint 51 is fixed to the inside of the mounting cylinder portion 145 by press-fitting welding. Inside the suction joint 51, the suction filter 52 is disposed.

The low-pressure fuel suction port 10*a* of the suction joint 51 communicates with the first communication hole 111*a* (see also FIG. 7) of the first holding member 9*a* via the mounting cylinder portion 145. The first communication hole 111*a* of the first holding member 9*a* is formed to be larger in diameter than the flow path diameter of the suction pipe 28 (see FIG. 1) attached to the suction joint 51. In addition, the diameter of the first communication hole 111*a* is set such that the first holding member 9*a* can maintain elastic deformation when the first holding member 9*a* is deformed by the damper cover 14A abutting on the contact portion 111 of the first holding member 9*a* (see also FIG. 6 and FIG. 8).

In the high-pressure fuel supply pump according to this modification, as illustrated in FIG. 9, the fuel flowing from the low-pressure fuel suction port 10*a* of the suction joint 51 flows to the low-pressure fuel chamber 10 via the first communication hole 111*a* of the first holding member 9*a*. The fuel in the low-pressure fuel chamber 10 further flows into the suction port 31*b* of the electromagnetic suction valve mechanism 300 through the second communication hole 113*a* of the first holding member 9*a* (see FIG. 6), the space P between the projections 116 of the first holding member 9*a* (see FIG. 6), and the third communication hole 121*a* of the second holding member 9*b* (see FIG. 6). In the electromagnetic suction valve mechanism 300, the capacitance control of the pump is performed as in the first embodiment.

According to the high-pressure fuel supply pump according to the modification of the above-described first embodiment of the invention, the same effects as those of the above-described first embodiment can be obtained.

In addition, according to this embodiment, since the suction joint 51 is configured to be attached to the damper cover 14A, there is no need to process the pump body 1 for mounting the suction joint 51 as illustrated in FIG. 10 compared with the case of the first embodiment in which the suction joint 51 is attached to the pump body 1 (see FIG. 3). In this case, it is necessary to form a mounting cylinder portion 142*a* by, for example, pressing the damper cover 14A. However, the pressing of the damper cover 14A can reduce the manufacturing cost more than the processing of the pump body 1.

Further, according to this embodiment, the diameter of the first communication hole 111*a* of the first holding member 9*a* is set to be larger than the flow path of the suction pipe (see FIG. 1) attached to the suction joint 51. Therefore, when the fuel flows into the low-pressure fuel chamber 10 from the low-pressure fuel suction port 10*a*, the pressure loss of the fuel due to the first communication hole 111*a* of the first holding member 9*a* can be suppressed.

In addition, according to this embodiment, the diameter of the first communication hole 111*a* of the first holding member 9*a* is set to a size that the first holding member 9*a* can maintain the elastic deformation when the damper cover 14 abuts on the contact portion 111 of the first holding member 9*a*. Therefore, plastic deformation of the first holding member 9*a* is prevented, and the metal damper 9 can be securely held in the low-pressure fuel chamber (damper chamber) 10 by the spring reaction force of the first holding member 9*a*.

Second Embodiment

Figure 12:
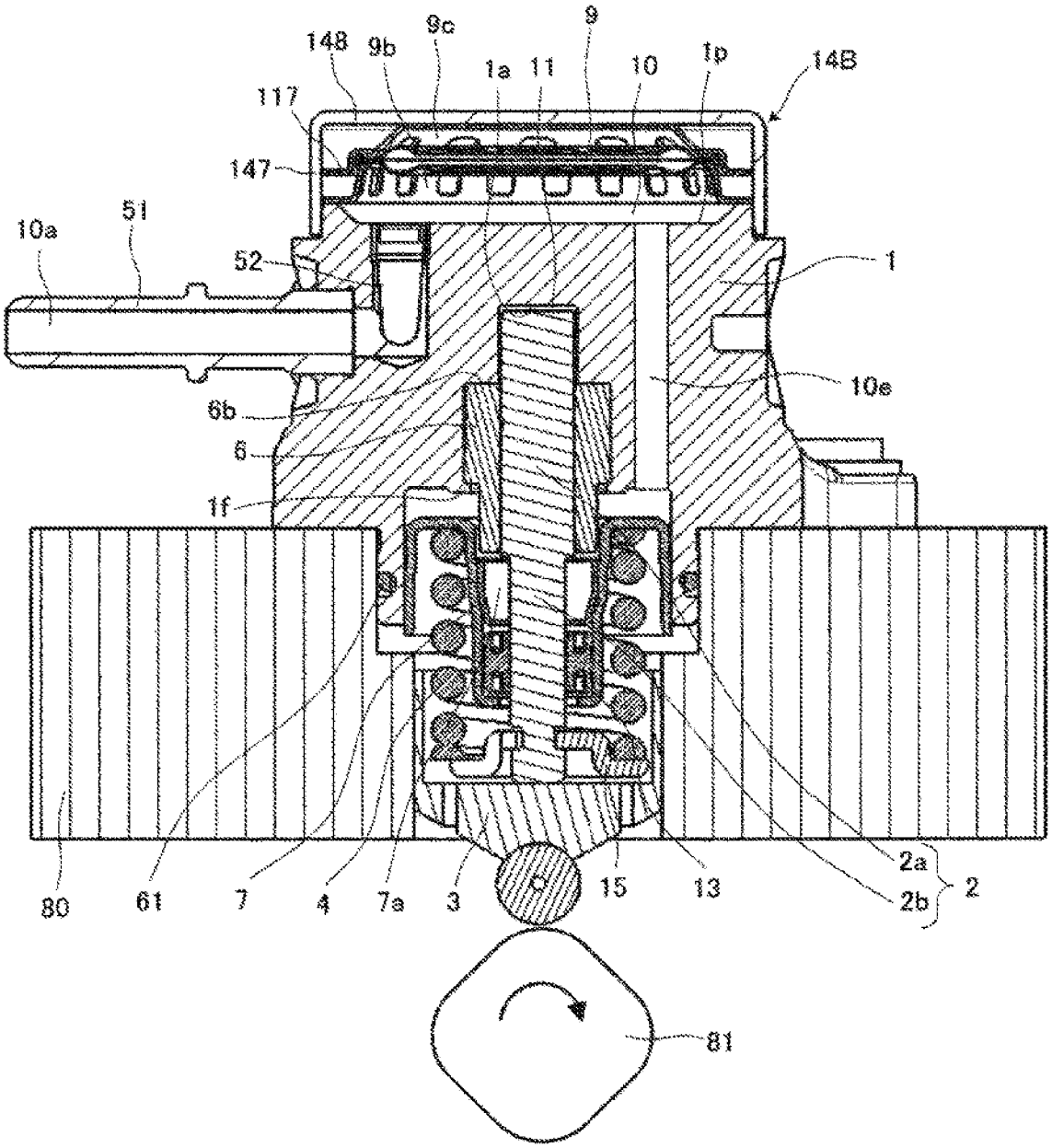
FIG. 12 is a longitudinal cross-sectional view illustrating a high-pressure fuel supply pump according to a second embodiment of the invention.
Figure 13:
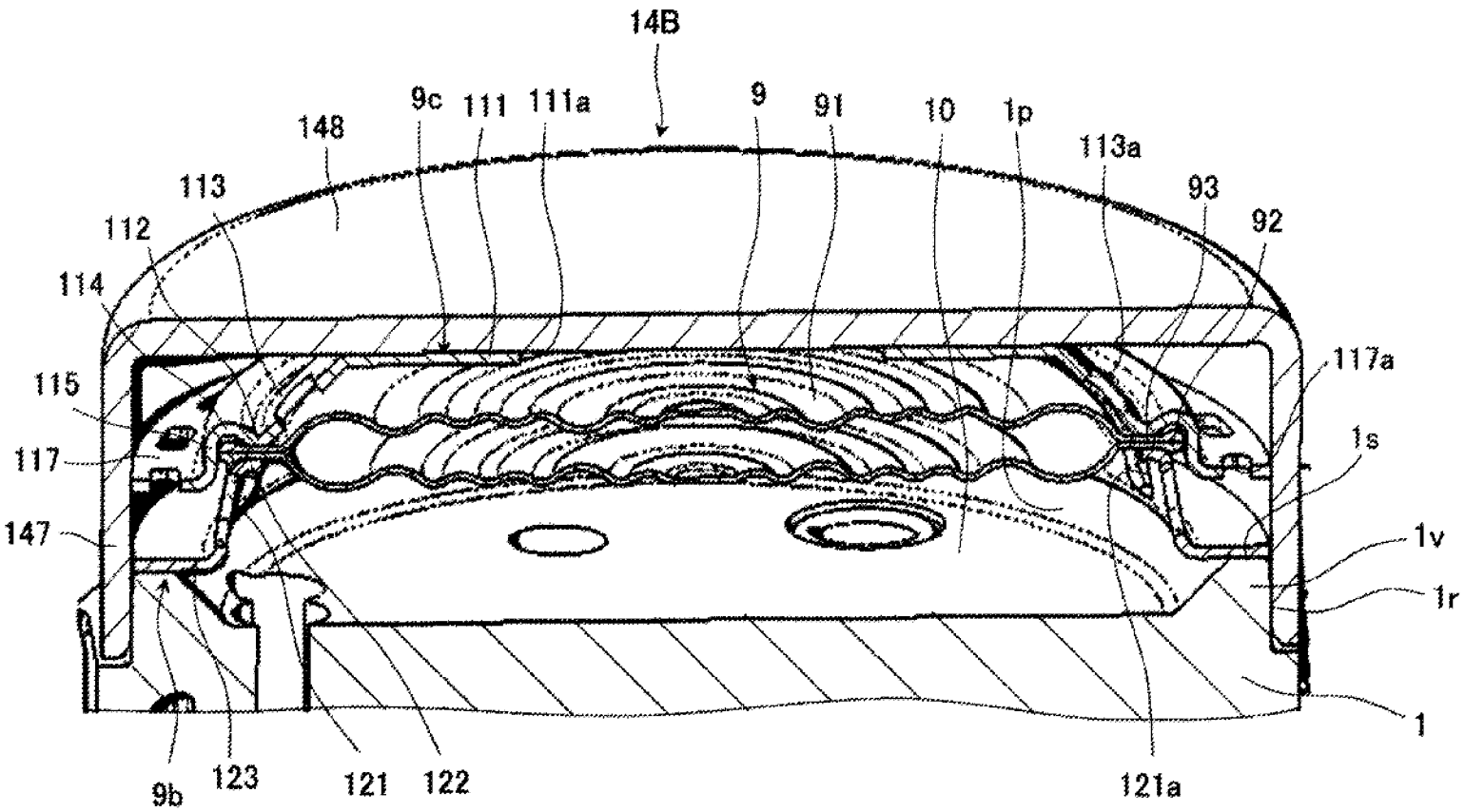
FIG. 13 is an enlarged perspective view illustrating a cut-away state of a metal damper and a holding structure thereof that form a part of a high-pressure fuel supply pump according to the second embodiment of the invention.
Figure 14:
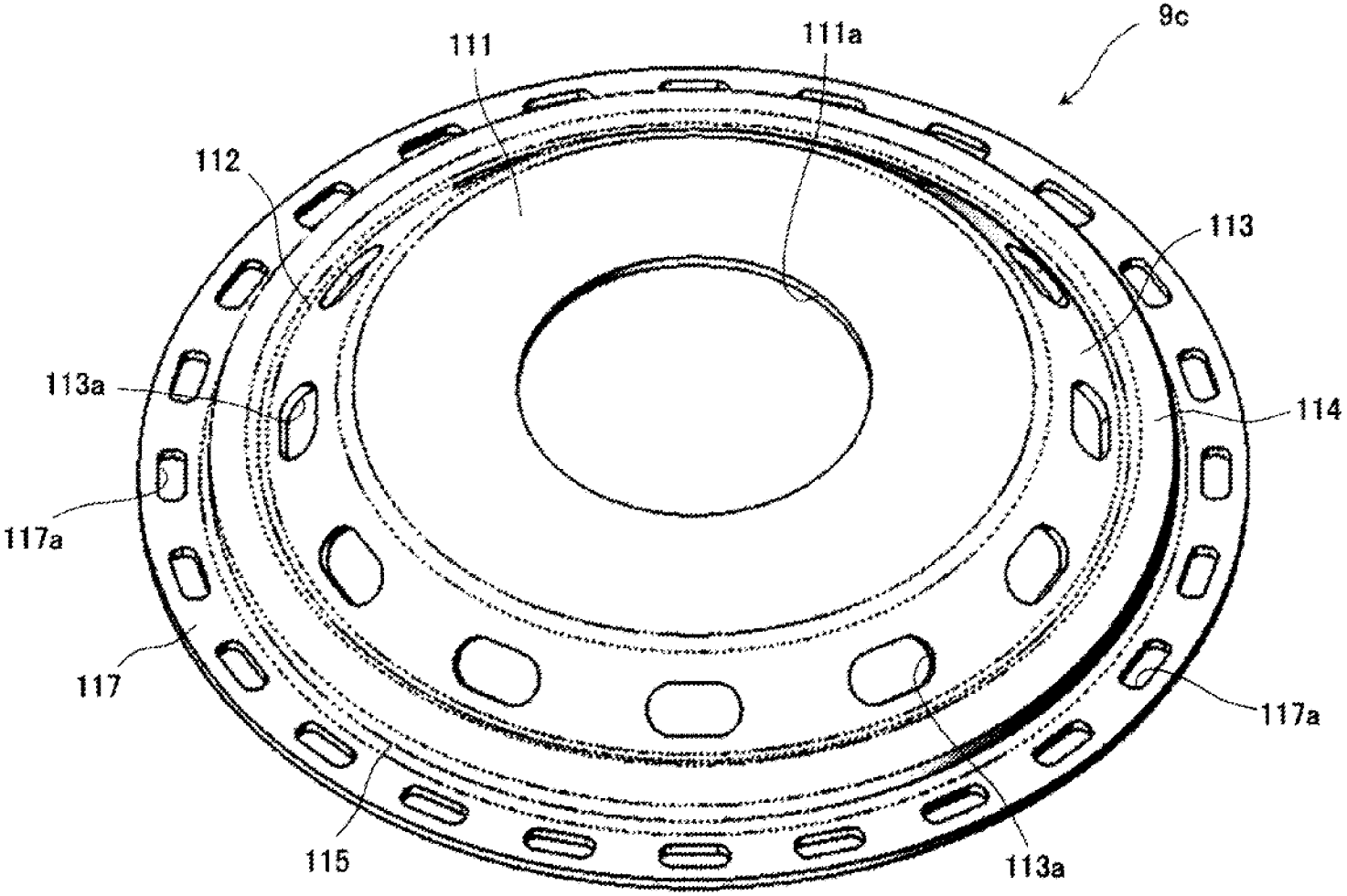
FIG. 14 is a perspective view illustrating a first holding member that forms a part of the high-pressure fuel supply pump according to the second embodiment of the invention illustrated in FIG. 13.

Next, a configuration of a high-pressure fuel supply pump according to a second embodiment of the invention will be described with reference to FIGS. 12 to 14. FIG. 12 is a longitudinal cross-sectional view illustrating the high-pressure fuel supply pump according to the second embodiment of the invention. FIG. 13 is an enlarged perspective view illustrating a cut-away state of a metal damper and a holding structure thereof that form a part of the high-pressure fuel supply pump according to the second embodiment of the invention. FIG. 14 is a perspective view illustrating a first holding member that forms a part of the high-pressure fuel supply pump according to the second embodiment of the invention illustrated in FIG. 13. Further, in FIGS. 12 to 14, the same reference numerals as those illustrated in FIGS. 1 to 11 are the same parts, and a detailed description thereof will be omitted.

The high-pressure fuel supply pump according to the second embodiment of the invention illustrated in FIG. 12 to is different from the high-pressure fuel supply pump according to the first embodiment in that a damper cover 14B is formed in a stepless cylindrical shape of which one side is closed, and a first holding member 9*c* has an annular flange 117 instead of the projection 116 (see FIG. 7) of the first holding member 9*a* of the first embodiment.

Specifically, as illustrated in FIGS. 12 and 13, the damper cover 14B is formed in a cylindrical, rotationally symmetric shape with one side closed, and three components of the first holding member 9*c*, the metal damper 9, and the second holding member 9*b* can be accommodated. That is, the damper cover 14B is configured by the cylindrical portion 147 and a circular closing portion 148 that closes one side of the cylindrical portion 147, and is formed by, for example, pressing a steel plate.

As illustrated in FIGS. 13 and 14, the first holding member 9*c* is an elastic body having a bottomed cylindrical shape (cup shape) and a rotationally symmetric shape, and is formed by, for example, pressing a steel plate. As in the first embodiment, the first holding member 9*c* includes the circular contact portion 111 having the first communication hole 111*a*, an annular pressing portion 112, a cylindrical first side wall surface portion 113 connecting a contact portion 111 and a pressing portion 112, the annular curved portion 114 protruding from the pressing portion 112, and a cylindrical enclosing portion 115 as a first regulation portion extending from the curved portion 114.

An annular flange 117 protruding radially outward is provided at an opening-side end of the enclosing portion 115. The flange 117 is configured to face the inner peripheral surface of the cylindrical portion 147 of the damper cover 14B with a gap within a predetermined range (fourth gap), and functions as a second regulation portion that regulates movement of the first holding member 9*c* in the radial direction in the low-pressure fuel chamber (damper chamber) 10. In other words, the flange 117 has a function of centering the first holding member 9*c* inside the damper cover 14B. The fourth gap between the outer edge of the flange 117 and the inner peripheral surface of the cylindrical portion 147 of the damper cover 14B is set in a range where the pressing portion 112 of the first holding member 9*c* does not to abut on the welding portion 92 of the metal damper 9 even if the first holding member 9*c* is shifted in the radial direction with respect to the damper cover 14B by the fourth gap.

A plurality of fourth communication holes 117*a* are provided in the flange 117 at intervals in the circumferential direction. The fourth communication hole 117*a* forms a communication path for communicating the space on one side (upper side in FIG. 13) of the metal damper 9 with the space on the other side (lower side in FIG. 13) of the metal damper 9, and functions as a flow path that allows the fuel in the low-pressure fuel chamber (damper chamber) 10 to circulate to both surfaces of the main body portion 91 of the metal damper 9. The width (the length in the radial direction) of the flange 117 is set in a range where the fourth communication hole 117*a* can be formed.

Figure 15:
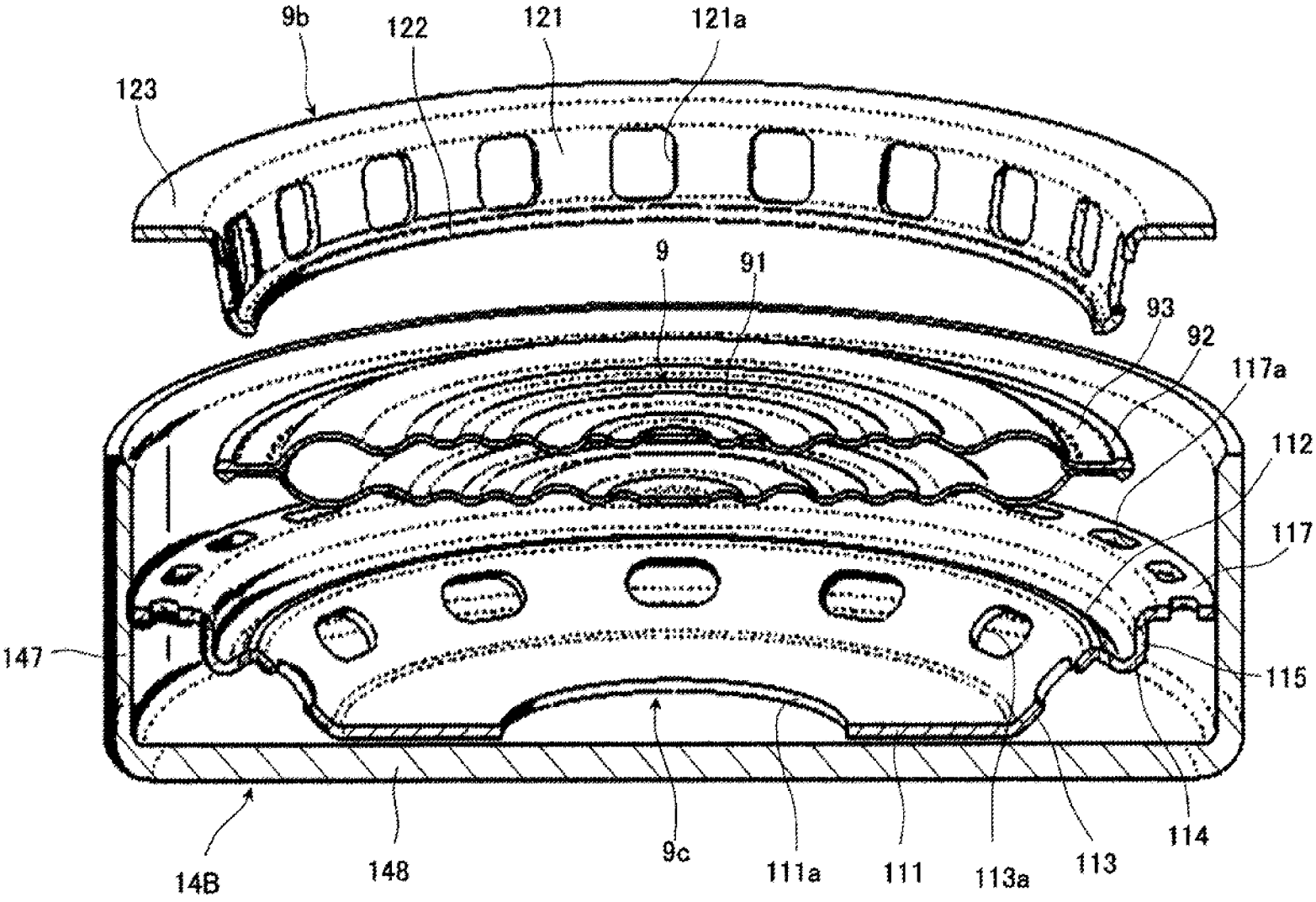
FIG. 15 is an explanatory view illustrating a step for assembling a metal damper in the high-pressure fuel supply pump according to the second embodiment of the invention.

(Step for Assembling Metal Damper) Next, the step for assembling the metal damper in the high-pressure fuel supply pump according to the second embodiment of the invention will be described with reference to FIG. 15. FIG. 15 is an explanatory view illustrating a step of assembling a metal damper in the high-pressure fuel supply pump according to the second embodiment of the invention.

As in the case of the first embodiment, the damper cover 14B is disposed such that the closing portion 148 is on the lower side and the opening is on the upper side, as illustrated in FIG. 15.

Next, the first holding member 9*c* is inserted into the damper cover 14B with the contact portion 111 facing downward, and placed on the closing portion 148 of the damper cover 14B.

At this time, the first holding member 9*c* is positioned in the radial direction within the damper cover 14B by its own flange 117. That is, the centering of the first holding member 9*c* in the damper cover 14B is performed only by inserting the first holding member 9*c* into the damper cover 14B. In this embodiment, since the fourth gap is provided between the flange 117 of the first holding member 9*c* and the inner peripheral surface of the cylindrical portion 147 of the damper cover 14B, the first holding member 9*c* is easily assembled to the damper cover 14B.

Next, the metal damper 9 is placed on the pressing portion 112 of the first holding member 9*c* in the damper cover 14B. At this time, the metal damper 9 is positioned in the radial direction in the first holding member 9*c* by the enclosing portion 115 of the first holding member 9*c*, as in the case of the first embodiment, and is centered in the damper cover 14B.

Subsequently, the second holding member 9*b* is inserted into the damper cover 14B with the pressing portion 122 facing downward, and is placed on the flat plate portion 93 of the metal damper 9. At this time, similarly to the case of the first embodiment, the second holding member 9*b* is radially positioned in the damper cover 14B by its own flange portion 123, and is centered in the damper cover 14B.

Finally, the end of the pump body 1 (see FIG. 13) on the side of the concave portion 1*p* is press-fitted into the cylindrical portion 147 of the damper cover 14B, and the end surface is of the pump body 1 on the side of the concave portion 1*p* is fixed by welding while pressing the flange portion 123 of the second holding member 9*b*. Thus, as in the case of the first embodiment, a spring reaction force is generated in the first holding member 9*c* and the second holding member 9*b*, and the urging force causes the metal damper 9 to be securely held inside the low-pressure fuel chamber (damper chamber) 10.

As described above, in the step for assembling the metal damper 9 in this embodiment, similarly to the case of the first embodiment, the first holding member 9*c*, the metal damper 9, and the second holding member 9*b* can be positioned (centered) in the damper cover 14B only by sequentially inserting the first holding member 9*c*, the metal damper 9, and the second holding member 9*b* into the damper cover 14B. Therefore, the positioning step of the components 9, 9*b*, and 9*c* is unnecessary.

In addition, since it is not necessary to assemble the three components of the first holding member 9*c*, the metal damper 9, and the second holding member 9*b* and assemble them into the damper cover 14B, the subassembly step for unitizing the components 9, 9*b*, and 9*c* is necessary.

Further, since the damper cover 14B, the first holding member 9*c*, the metal damper 9, and the second holding member 9*b* are each formed in a rotationally symmetric shape, only the axial direction of the component needs to be considered when assembling.

Therefore, it is possible to improve productivity and reduce costs by simplifying the assembly process.

According to the high-pressure fuel supply pump according to the above-described second embodiment of the invention, the same effects as those of the above-described first embodiment can be obtained.

In addition, according to this embodiment, since the damper cover 14B is formed in a bottomed cylindrical shape with no step, the step for forming a step can be omitted, and the manufacturing cost of the damper cover 14B can be reduced compared with the configuration of the stepped bottomed cylindrical shape as in the damper cover 14 of the first embodiment (see FIG. 9).

Further, according to this embodiment, since the annular flange 117 is used as the second regulation portion of the first holding member 9*c*, the risk of deformation is small, and the function of the second regulation portion can be reliably exhibited compared with the projection 116 used as the second regulation portion of the first embodiment (see FIG. 7).

Further, the invention is not limited to the above embodiments, but various modifications may be contained. The above-described embodiments have been described in detail for clear understating of the invention, and are not necessarily limited to those having all the described configurations. Some of the configurations of a certain embodiment may be replaced with the configurations of the other embodiments, and the configurations of the other embodiments may be added to the configurations of a certain embodiment. In addition, some of the configurations of each embodiment may be omitted, replaced with other configurations, and added to other configurations.

REFERENCE SIGNS LIST

1 pump body
14, 14A, 14B damper cover
9 metal damper (damper)
9*a*, 9*c* first holding member
9*b* second holding member
10 low-pressure fuel chamber (damper chamber)
11 pressurizing chamber
28 suction pipe
92 welding portion
111 contact portion
111*a* first communication hole (communication hole)
112 pressing portion
113 first side wall surface portion (side wall surface portion)
113*a* second communication hole (communication hole)
115 enclosing portion (first regulation portion)
116 projection (second regulation portion)
117 flange (second regulation portion)
117*a* fourth communication hole (flow path)
123 flange portion (third regulation portion)
P space (flow path)

The invention claimed is:

1. A high-pressure fuel supply pump, comprising:
a pump body that includes a pressurizing chamber inside;
a damper cover that forms a damper chamber on an upstream side of the pressurizing chamber together with the pump body;
a damper that is disposed in the damper chamber and formed by laminating two diaphragms; and
a first holding member that is disposed in the damper chamber and presses and holds the damper from one side,
wherein the first holding member includes
a first regulation portion for regulating movement of the damper in the radial direction, and
a second regulation portion that regulates a radial movement of the first holding member in the damper chamber,
wherein a flow path that allows fuel in the damper chamber to circulate to both surfaces of the damper is formed at the position of the second regulation portion,
wherein the damper cover is capable of accommodating the damper and the first holding member, and is formed in a tubular shape with one side closed,
wherein the first holding member is configured such that a gap is formed between the second regulation portion and an inner peripheral surface of the damper cover,
wherein the damper includes a welding portion formed by welding a periphery of the two diaphragms, and
wherein the gap is set in a range where the first holding member does not abut on the welding portion of the damper, even in a case where the first holding member is displaced by the gap in a radial direction.

2. The high-pressure fuel supply pump according to claim 1,
wherein the second regulation portion is provided at intervals in a circumferential direction of the first regulation portion, and is configured by a plurality of projections protruding radially outward, and
wherein the flow path is configured by a plurality of spaces formed between adjacent projections among the plurality of projections.

3. The high-pressure fuel supply pump according to claim 1, wherein the second regulation portion is configured by a flange formed in an annular shape, and wherein the flow path is configured by a communication hole provided in the flange.

4. The high-pressure fuel supply pump according to claim 1, further comprising:

a second holding member that is disposed on an opposite side of the first holding member with the damper interposed in the damper chamber and presses and holds the damper from the other side.

5. The high-pressure fuel supply pump according to claim 4, wherein the second holding member includes a third regulation portion that regulates radial movement of the second holding member in the damper chamber.

6. The high-pressure fuel supply pump according to claim 5, wherein the damper cover is capable of accommodating the three members of the damper, the first holding member, and the second holding member, and is formed in a tubular shape with one side closed, and wherein the second holding member is configured such that a gap is formed between the third regulation portion and an inner peripheral surface of the damper cover.

7. The high-pressure fuel supply pump according to claim 6, wherein the damper includes a welding portion formed by welding a periphery of the two diaphragms, and wherein the gap is set in a range where the second holding member does not abut on the welding portion of the damper even in a case where the second holding member is displaced by the gap in a radial direction.

8. The high-pressure fuel supply pump according to claim 1, wherein the first holding member includes a contact portion that abuts on the damper cover, a pressing portion that presses the damper, and a cylindrical side wall surface portion that connects the contact portion and the pressing portion, and wherein the side wall surface portion includes a communication hole that allows communication between a radially inner space and a radially outer space.

9. The high-pressure fuel supply pump according to claim 1, wherein the first regulation portion is formed so as to surround a periphery of the damper.

10. The high-pressure fuel supply pump according to claim 1, wherein the first holding member includes a contact portion that abuts on the damper cover, and wherein the contact portion includes a communication hole having a diameter larger than a flow path diameter of a suction pipe that is attached to the high-pressure fuel supply pump.

11. The high-pressure fuel supply pump according to claim 10, wherein the first holding member is an elastic body that is elastically deformed by contact with the damper cover, and wherein a diameter of the communication hole of the contact portion is set to a size capable of maintaining elastic deformation when the first holding member is deformed by the contact of the damper cover.

12. The high-pressure fuel supply pump according to claim 11, wherein the contact portion is formed in a planar shape.

* * * * *